US005937690A

United States Patent [19]

Pomerleau

[11] Patent Number: 5,937,690

[45] Date of Patent: Aug. 17, 1999

[54] MOVABLE CRIMPING DEVICE

[76] Inventor: Marcel Pomerleau, 137 Ste-Christine, Beauport, Québec, Canada, G1E 7B2

[21] Appl. No.: 08/956,475

[22] Filed: Oct. 23, 1997

[51] Int. Cl.[6] ..... B21D 39/03

[52] U.S. Cl. ..... 72/325; 29/432.2; 29/243.5

[58] Field of Search ..... 72/325, 453.16, 72/453.15; 29/432.2, 432.1, 432, 243.5, 21.1, 243.58, 243.57

[56] References Cited

U.S. PATENT DOCUMENTS

| | | | |
|---|---|---|---|
| 2,800,960 | 7/1957 | Cutler | 29/21.1 |
| 2,800,961 | 7/1957 | Cutler | 29/21.1 |
| 3,110,340 | 11/1963 | Valverde . | |
| 3,505,714 | 4/1970 | Boileau . | |
| 3,815,235 | 6/1974 | Marlar | 29/21.1 |
| 3,877,280 | 4/1975 | Cornell | 72/325 |
| 4,056,870 | 11/1977 | Biloff | 29/21.1 |
| 4,424,618 | 1/1984 | Stubbings | 29/243.5 |
| 4,571,975 | 2/1986 | Pawloski et al. . | |
| 5,040,400 | 8/1991 | Nastasi | 72/325 |

FOREIGN PATENT DOCUMENTS 1002281 12/1976 Canada .

*Primary Examiner*—Daniel C. Crane
*Attorney, Agent, or Firm*—Françcois Martineau

[57] ABSTRACT

A telescopic column is movable along and installed between a flooring sill rail and a ceiling rail. The column has an upper set of wheels engaging the upper rail and a lower set of wheels engaging the lower sill rail, for guiding the column along the rails. A crimping head according to the invention is provided at both extremities of the column, for anchoring at selected intervals a number of vertical studs on the bottom sill rail and on the upper ceiling rail. Each crimping head is positioned inside the C-shaped corresponding rail, and the studs are positioned so that each crimping head is flanked on both sides by two adjacent rail and stud walls. Each crimping head comprises two knives which can pivot in opposite directions away from the column, so as to pierce simultaneously both the rail and stud walls, thus creating outturned complementary lips and a stud window engaged by the lips so as to prevent relative movement of the stud and the rail. The pivoting knives are controlled by means of a mechanically-activated hydraulic piston.

8 Claims, 16 Drawing Sheets

100
155b
116
35
35
155a
114

106
108
116
155a'''
159

114
159
155a'''
155a''
155a'

100
116
110
112
155b
32
32
114
106
108
155a 106
108
161
114
159
155a'

MOVABLE CRIMPING DEVICE

FIELD OF THE INVENTION

The present invention relates to wall constructions, and more particularly to a movable crimping unit for use in erecting wall studs between a flooring and a ceiling.

BACKGROUND OF THE INVENTION

U.S. Pat. No. 3,505,714 issued in 1967 to G. Boileau discloses the prior art relating to clipping or crimping metallic structural elements to each other. The Boileau patent shows clipping pliers having a pair of handles connected to one another and to a pair of jaws for clipping two metallic sheet elements to each other. One jaw is provided with a punch element having a pointed tip, and the other jaw is provided with an anvil portion. FIG. 2 of this patent shows the use of this tool, wherein two parallel and adjacent sheet elements are to be clipped. The anvil portion of the tool rests on one side of the pair of metallic sheet elements, and the punch is destined to engage the other side thereof, with the pointed tip piercing the two sheet elements and integrally linking one to the other thereby due to a pair of inter-nesting outturned lips formed in the sheet elements by said punch.

The invention disclosed in the Boileau patent is used to fixedly attach a number of vertical studs to a floor sill plate and a ceiling plate, for erecting a wall structure. This is accomplished by clipping each wall stud twice to the sill plate and twice to the ceiling plate. Indeed, the sill plate, ceiling plate and stud are usually channel-sectioned, i.e. with a main web and two edgewise longitudinal perpendicular side walls, thus forming a U-shaped cross-section. For erecting a wall structure, a number of structural studs are vertically positioned between the horizontal floor sill and the horizontal ceiling plate, with each channel-shaped stud engaging the interior channel of both the sill plate and the ceiling plate so that their side walls be parallel and adjacent at both extremities of the stud. Clipping of the stud to the ceiling plate is then accomplished, usually on both pairs of stud and ceiling plate adjacent walls. The same is accomplished for attaching the stud to the sill plate.

This requires that the work person handling the Boileau clipping tool clip four times the metallic sheets for each stud. Moreover, for reaching the ceiling plate, the work person will most likely need to use a scaffold or a self-standing ladder, which increases the complexity of the clipping operation, and the likelihood of the work person wounding himself by accidentally falling off his scaffold or ladder.

Another disadvantage of the Boileau patent is that the plier clipping tool shown therein does not reach very far inside the side walls of the channel-shaped studs and sill and ceiling plates: consequently, the clipping of the stud to the floor sill or of the stud to the ceiling plate, will often be very close to the edge of their side walls, which results in a less reliable attachment. The clipping must indeed be accomplished closer to the web of the channel-shaped stud and plate walls. Also, when trying to reach further away from the side edges of the stud and plate walls, the work person may try to clip the metallic sheets by twisting the pliers into an inefficient angle to obtain a better clipping position: this is also undesirable.

In Canadian patent application No. 2,072,762 published on Dec. 30, 1993 by the present applicant, there is disclosed an upright column equipped with a set of wheels and a crimping head unit at both its upper and its lower extremities. The column is destined to be inserted between a lower sill plate, fixedly attached to the floor, and an upper plate, fixedly attached to the ceiling. The column wheels rotatably engage the upper and sill plates to allow movement of the column therealong. The crimping head units installed at each extremity of the vertical column are not detailed in this Canadian application, except that it is stated that their purpose is to fixedly attach vertical studs onto the sill and upper plates. The studs, sill plate and upper plate are made of a metallic material.

OBJECTS OF THE INVENTION

It is an object of this invention to provide a movable crimping device which allows fixed installation of vertical studs without the use of a scaffolding.

It is another object of this invention that the crimping device be independently mechanically controlled, to allow use thereof without an electrical power supply.

It is yet another object of the present invention that the crimping device be of adjustable length and size to allow use thereof on structures of different sizes.

SUMMARY OF THE INVENTION

The invention generally relates to a telescopic column is movable along and installed between a flooring sill rail and a ceiling rail. The column has an upper set of wheels engaging the upper rail and a lower set of wheels engaging the lower sill rail, for guiding the column along the rails. A crimping head according to the invention is provided at both extremities of the column, for anchoring at selected intervals a number of vertical studs on the bottom sill rail and on the upper ceiling rail. Each crimping head is positioned inside the C-shaped corresponding rail, and the studs are positioned so that each crimping head is flanked on both sides by two adjacent rail and stud walls. Each crimping head comprises two knives which can pivot in opposite directions away from the column, so as to pierce simultaneously both the rail and stud walls, thus creating outturned complementary lips and a stud window engaged by the lips so as to prevent horizontal relative movement of the stud and the rail. The pivoting knives are controlled by means of a mechanically-activated hydraulic piston.

More particularly, the present invention relates to a crimping device for use in integrally attaching the opposite ends of an elongated cross-sectionally U-shaped stud in upright condition to registered portions of cross-sectionally U-shaped rail members anchored to a flooring and a ceiling of a building, said crimping device comprising:

a) an elongated column having first and second opposite ends each provided with a wheel carriage assembly destined to removavly engage the rails of the flooring and ceiling respectively and to be movable therealong;

b) a crimping head downwardly depending from each end of said column, and comprising a frame, fixedly attached to said column, a pair of knife members and knife mounting means for mounting said knife members to said frame for relative movement of said knife members between a inoperative, resting position and an operative, crimping position in register with a side leg of the building rail and of the stud;

c) power means, for focibly selectively pivoting said knife members between said resting position and said crimping position;

wherein crimping of the stud to the building rails is accomplished by activating said power means for pivoting said knife members relative to one another from said resting position into said crimping position.

Preferably, said power means includes a hydraulic fluid system, integral to said column, and a powered hydraulic cylinder operatively coupled to said hydraulic fluid system and installed on each said crimping head frame and having a piston rod pivotally linked to said knife members, so that each of the extraction and retraction of said cylinder correspond to a pivoting displacement of said knife members into either one of said resting or crimping positions.

Preferably, said power means further includes a spring member mounted inside said frame and biasing said knife members into their resting position.

Preferably, said power means further includes a manual pump lever, for generating pressure build-up in in said hydraulic cylinder for driving its piston rod to pivot the knife members in their extended operative position.

Preferably, said column is telescopic so as to have an adjustable height.

Advantageously, the crimping device further comprises stabilizing means, mounted to said column opposite ends and releasably engageable to the flooring and ceiling rails, for preventing said column from accidentally releasing the building rails under its own load.

Preferably, said stabilizing means comprises at least one elongated stabilizing arm having one end transversely pivotally attached to said column and having an opposite end destined to slidingly engage either one of the floor sill and the upper plates.

Advantageously, said stabilizing means comprises two stabilizing arms for engaging the ceiling rail and the flooring rail, respectively.

Preferably, said wheel carriage assembly has width adjustment means, to allow said wheel carriage assembly to fit onto ceiling and flooring rails of different widths.

Preferably, each said crimping head comprises a pair of rigid support panels fixedly attached to said crimping head frame on opposite sides thereof, each said panel being in spaced, facing register with a corresponding said knife member and being destined to be located on the opposite side, relative to said knife, of a rail side wall and a registering stud side wall to be crimped, said support plates forming abutment surfaces being abutted by the stud side wall to prevent accidental deformation of the rail under the bias of the outward extended operative pivotal crimping displacement of said knife members.

Preferably, the distance between said knife members and said column can be adjusted, so as to allow crimping of studs and rails of different widths, and wherein the position of each said panel can also be adjusted, so that it register in a regularly spaced relationship with its associated knife member.

Preferably, said crimping unit further comprises at least one guide arm attached to one end of said column, said guide arm having metering means for measuring a set distance between two successive studs.

The invention further relates to a crimping head for use in integrally attaching the top and bottom ends of an upright stud to an overhanging rail and a ground laying rail along corresponding flat abutting walls to be mutually crimped into an integral attachment, said crimping head comprising:

a) a rigid frame;

b) a pair of knife members;

c) mounting means for mounting said knife members to said frame for relative movement between a knife resting position and a knife crimping position; and d) a manually powered hydraulic cylinder having a piston rod and a pivotal arm linkage pivotally linking said piston rod to said knife members, so that each of the extraction and retraction of said cylinder correspond to a pivoting displacement of said knife members into either one of a resting or a crimping position, said manually powered hydraulic cylinder being for selectively pivoting said knife members between said resting position and said crimping position;

wherein crimping of the respectively abutting walls of the stud and rails is accomplished by manually operating said hydraulic cylinder for pivoting said knife members from said resting position into said crimping position.

Preferably, the previously mentioned crimping head further comprises a pair of anvil members fixedly attached to said crimping head frame, each said panel being in spaced, facing register with one of said knife members and being destined to be located on the opposite side, relative to said knife member, of said corresponding stud and rail abutment walls to be crimped, for preventing accidental rail wall deformation under the impacting load of the knife members penetrating these rails and stud walls.

Preferably, the position of said knife members can be adjusted relative to said piston rod, so as to allow crimping of stud and rail walls of different widths, and wherein the position of each said panel can also be adjusted, so that it register in a regularly spaced relationship with its associated knife member.

The present invention further relates to a crimping unit for fixedly interconnecting a first pair of self-abutting metallic sheets and a second pair of self-abutting metallic sheets spaced from the first pair of sheets, said crimping unit comprising:

a) an open rigid main frame;

b) a pair of anvil members, fixedly mounted to opposite sides of said main frame spacedly therefrom wherein a pair of channels are formed between the anvil members and the open frame, each said channel for free passage of a corresponding pair of metallic sheets;

c) a pair of knives, each knife having a main body and a metal shearing surface coextensive to said main body;

d) mounting means, for mounting said knives main body to said main frame wherein said shearing surfaces register with corresponding said channels, and for relative movement of said knives thereabout between a retracted inoperative position, clearing said channels, and an extended operative position, crossing transversely through said channels; and e) ram means, for power extending said knives from their inoperative position to their operative position;

wherein each said knife can impale its corresponding pair of self-abutting metallic sheets inside its said channel and against its said anvil member, to form windows in the metallic sheets and sheet interlocking lips transversely depending edgewisely from the windows.

Preferably, said crimping unit further includes:

a) biasing means, to bias said knives from their operative position to their inoperative position; and b) a bevel made along each said knife shearing surface, said bevel forming a small acute angle to substantially prevent the knife from getting accidentally stuck into the window formed through the metallic sheets against the bias of the biasing means, and thus to enable ready return of the knife to its inoperation position yieldingly to the bias of said biasing means.

Advantageously, said small acute angle of the bevelled knife shearing surface ranges between 4 and 10°.

Preferably, said crimping unit further includes a transverse notch made on an intermediate section of the knife shearing surface, said notch for generating rolling action of the cut metal lip following sheet penetration by said knives under power from said ram means, said metal lip rolling action improving sheet interlock.

Preferably, said crimping unit further includes a transversely offset elbow, made intermediately of each knife; wherein said knives are movable within closely spaced parallel planes during their displacement from inoperative to operative positions, each knife forming a generally flat panel but for the offset elbow so that said knife shearing surfaces are both within substantially the same plane.

DETAILED DESCRIPTION OF THE PREFERRED EMBODIMENTS

Figure 1:
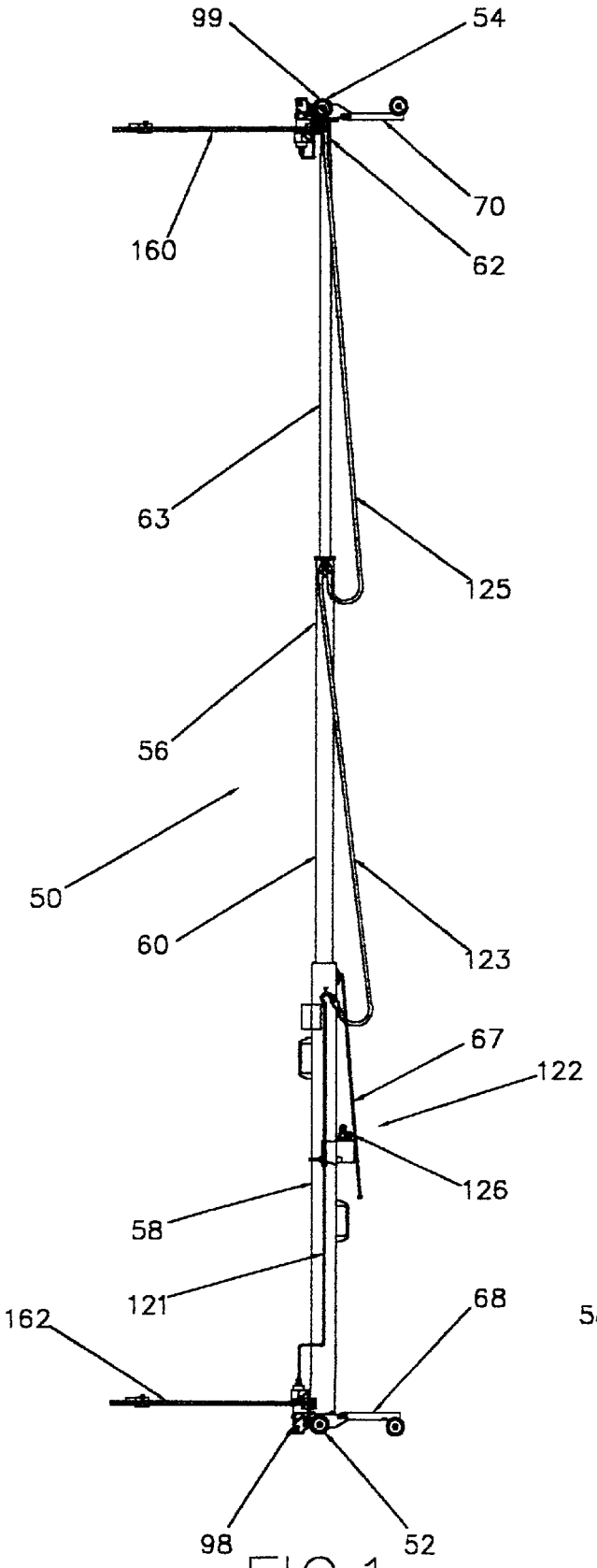
FIGS. 1 and 2 are a lateral side elevation and a front elevational view, respectively, of the crimping device according to the invention.
Figure 2:
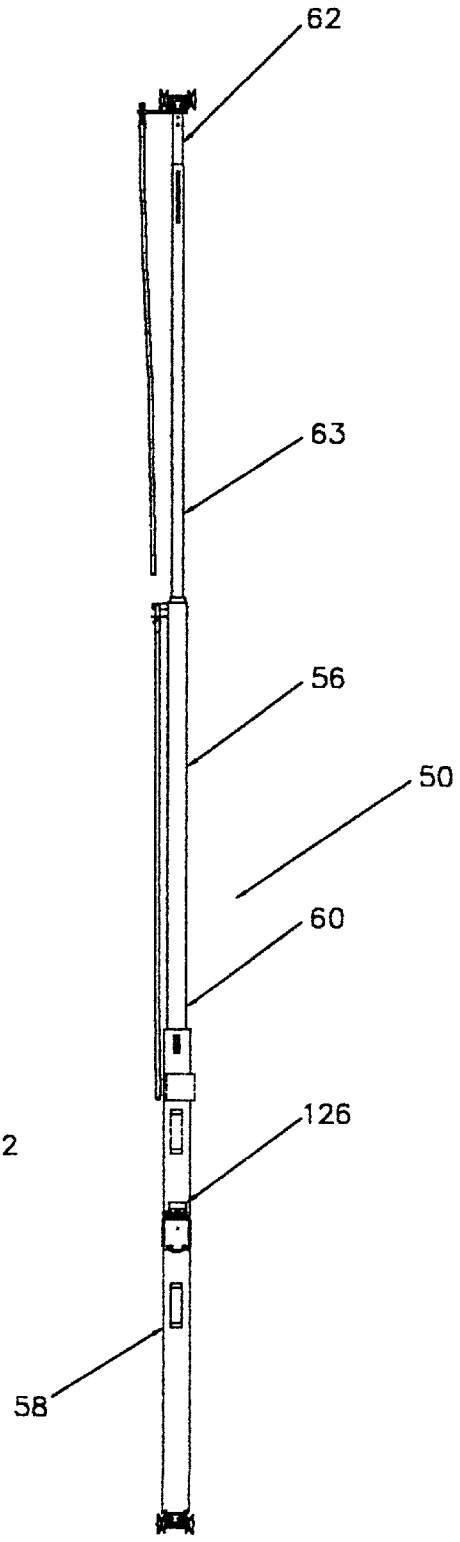

FIGS. 1 and 2 show a crimping device 50 according to the invention. The crimping device is destined, as described in the "Background of the Invention" section of the present specification, to be inserted between a floor sill fixedly attached to the room floor and a parallel upper plate fixedly attached to the room ceiling. A number of studs are to be fixedly attached in upright condition at their lower extremities to the sill and at their upper extremities to the upper plate. The floor sill, the upper plate and the upright studs are of conventional make and comprise a lengthwise main web defining two sides from which edgewisely project at least a pair of perpendicular side walls. Thus, the sill, studs and upper plate can form a channel section (or C-shaped section), or an I-shaped section. For the purposes of the present description, the sill plate, studs and upper plate will have a C-shaped cross-section. The flat web portion of the sill and upper plates are fixed to the floor and ceiling, respectively, and the side walls thereof project inwardly into the room.

The purpose of the construction is to assemble a wall structure, comprising a number of equally spaced vertical studs, as known in the art, for thereafter attaching thereto vertical wall panels. When the wall structure is to be assembled, it is known to position the side walls of the studs adjacent and parallel to the side walls of the plates and sill, to fixedly attach them to one another.

Crimping device 50 comprises a lower set of support wheels 52 destined to engage the upwardly projecting side walls of the channel shaped sill (not shown) and on which mainly rests device 50, and an upper set of wheels 54 destined to engage the downwardly projecting side walls of the channel shaped upper ceiling plate (not shown). Wheel sets 52, 54 are rotatably journalled at both the upper and the lower extremities of a vertical telescopic column 56. Each wheel of sets 52, 54 preferably has a cross-sectioned V-shaped rim, as illustrated.

Figure 3:
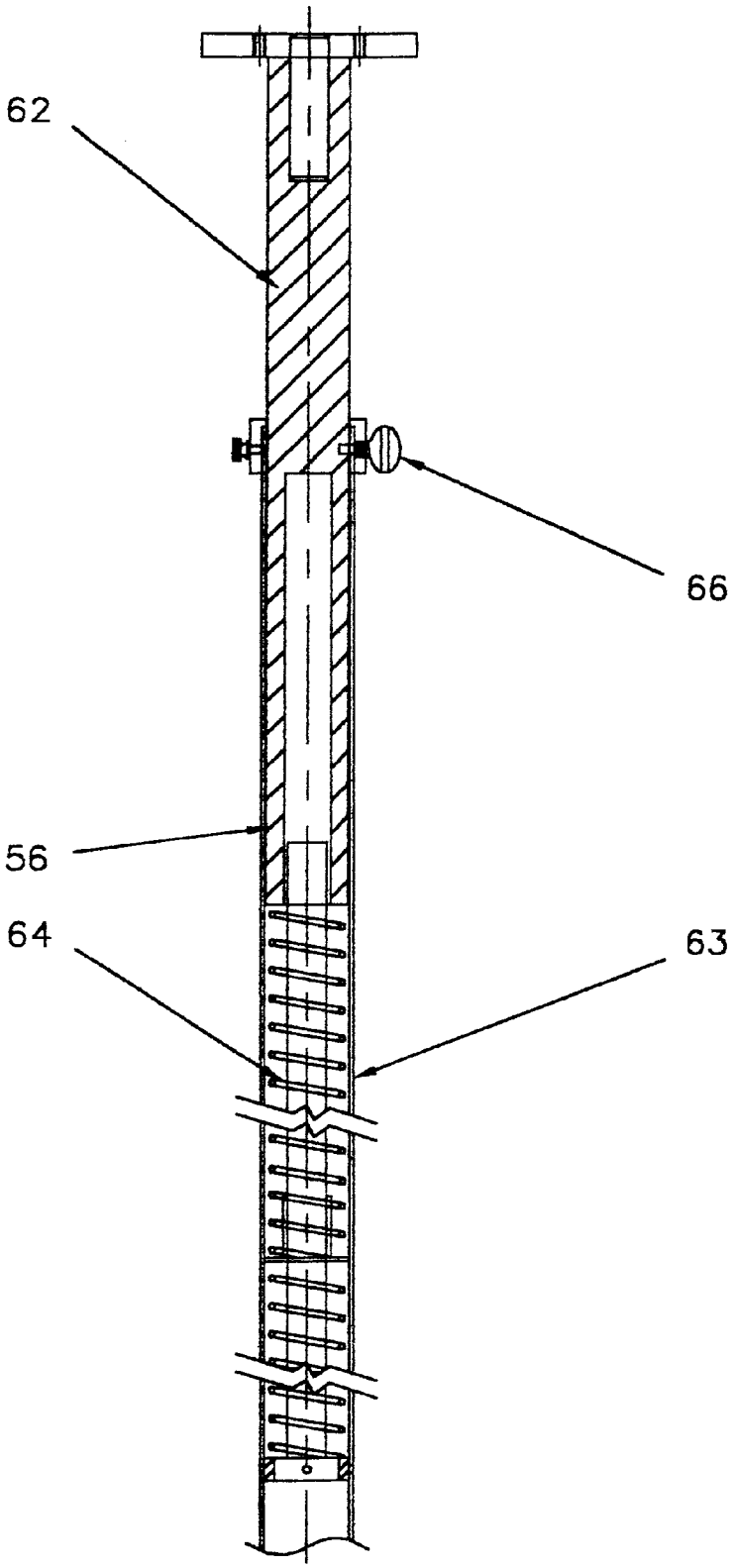
FIG. 3 is a partly broken longitudinal sectional view, at an enlarged scale, of the upper portion of the movable column of the crimping device.

As shown in FIGS. 1 to 3, column 56 comprises a lower sleeve 58 in which axially slides an intermediate sleeve 60, and an upper rod 62 axially sliding into an upper sleeve 63 which in turn slides into intermediate sleeve 60. A coil spring 64 is compressed inside upper sleeve 63 and upwardly biases upper rod 62, which can be adjusted at a desired vertical position by means of a set screw 66. The intermediate and upper sleeves 60, 63 are similarly upwardly biased by another coil spring (not shown) located in lower sleeve 58, and their vertical position can thus be similarly adjusted with set screws (not shown). The height of column 56 can thus be easily adjusted by releasing the set screws and allowing the intermediate and upper sleeves 60, 63 and the upper rod 62 to telescopically slide upwardly under the driving force of the compressed springs under them, until the upper set of wheels 54 engage the upper ceiling plate.

It is also envisioned to provide a string 67 protruding on lower sleeve 58, and which is connected to the overlying sleeves and rod 60, 63, 62 by means of a number of pulleys; this arrangement is similar to telescopic ladders which are used by firemen. When the column needs to be retracted or extracted, the string may be manually pulled or released by an operator on the floor and springs, ropes and pulleys allow all the sleeves and rod 60, 63, 62 to be extracted/retracted simultaneously. With this last string embodiment, the upright column 56—which can be much higher than an adult person—can be fitted between a floor sill and a ceiling plate by manually retracting from ground level the column with the string, positioning the column on the floor sill, and then gradually releasing the string until the upper set of wheels 54 engages the ceiling plate. Thus, with the coil springs applying continuous pressure on both the upper and lower set of wheels 54, 52, the column is rather securely compressed between the ground sill and ceiling plate.

Figure 6:
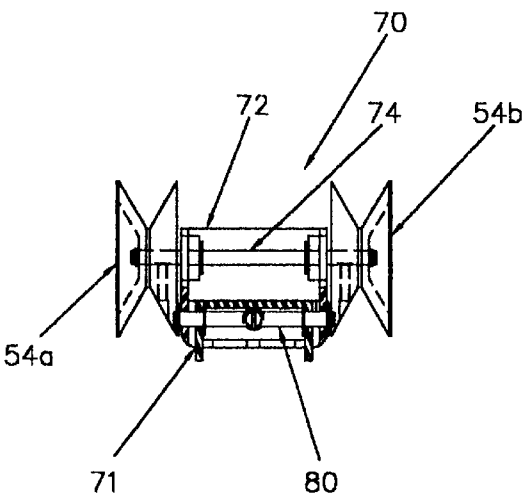
FIG. 6 is a cross-sectional view taken along line 6—6 of FIG. 5.
Figure 4:
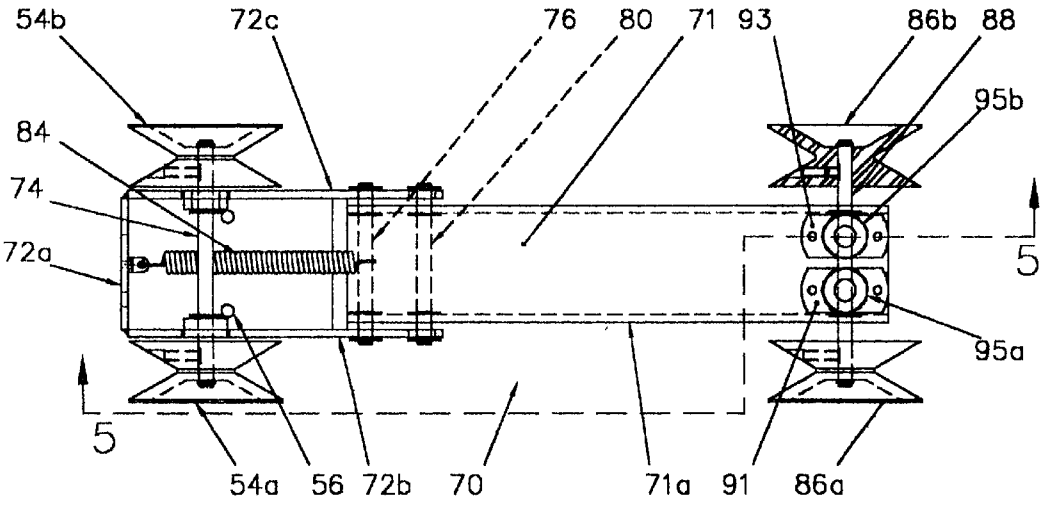
FIG. 4 is a top plan view, partly in cross-section and at an enlarged scale, of the upper stabilizing arm or carriage of the column supporting the upper set of wheels of the vertical column.
Figure 5:
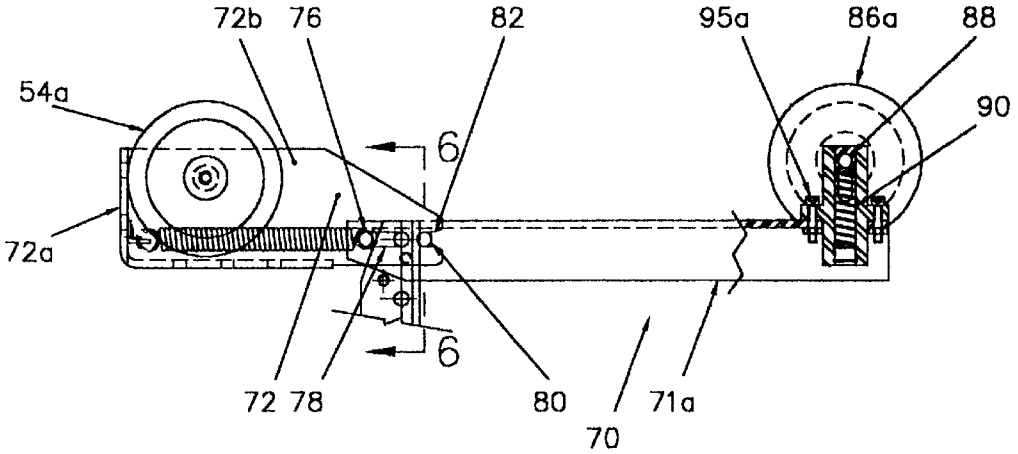
FIG. 5 is a partly sectional lateral side elevation of the elements of FIG. 4, taken along broken line 5—5 of FIG. 4.

To prevent the high vertical column (it may be for example sixteen feet high when completely extracted) from tilting under its own load, a lower and an upper stabilizing arms 68, 70 are provided on column 56. FIGS. 4 to 6 show upper stabilizing arm 70, and it is understood that lower stabilizing arm 68 is a mirror image thereof.

Upper stabilizing arm 70 has an elongated main body 71 generally U-shaped in cross-section (FIG. 6), and is installed, in a manner described hereinafter, on an upper generally cross-sectionally U-shaped rigid casing 72 further having an end wall 72*a* opposite arm 70. The opposite side walls of casing 72 rotatably hold the spindle 74 of the upper set of wheels 54, the latter comprising two idle wheels 54*a*, 54*b*. Upper arm main body 71 is pivotally supported by a transverse pivot shaft 76 integrally attached at opposite side walls of U-shaped arm main body 71 and extending through a pair of horizontal elongated ovoidal slots 78, 78 which are made in the opposite spaced side walls 72*b*, 72*c* of U-shaped casing 72. A second securing shaft 80 parallel to pivot shaft 76 and fixed to opposite side walls of arm main body 71 can engage complementary notches 82, 82 in the opposite side walls of the end portion of casing 72. Pivot shaft 76 can horizontally slide along ovoidal slots 78, 78, and a coil spring 84, attached to and extended between the casing end wall 72*a* and pivot shaft 76, biases the latter into a retracted limit position, i.e. towards column 56, and concurrently biases securing shaft 80 into engagement with notches 82, 82. In this retracted position of arm 70, securing shaft 80 freely abuts into notches 82, 82, and thus accidental pivotal displacement of arm 70 is prevented. The latter is consequently maintained in a horizontal position, in its retracted position, and as shown in FIGS. 4 to 6.

Figure 7:
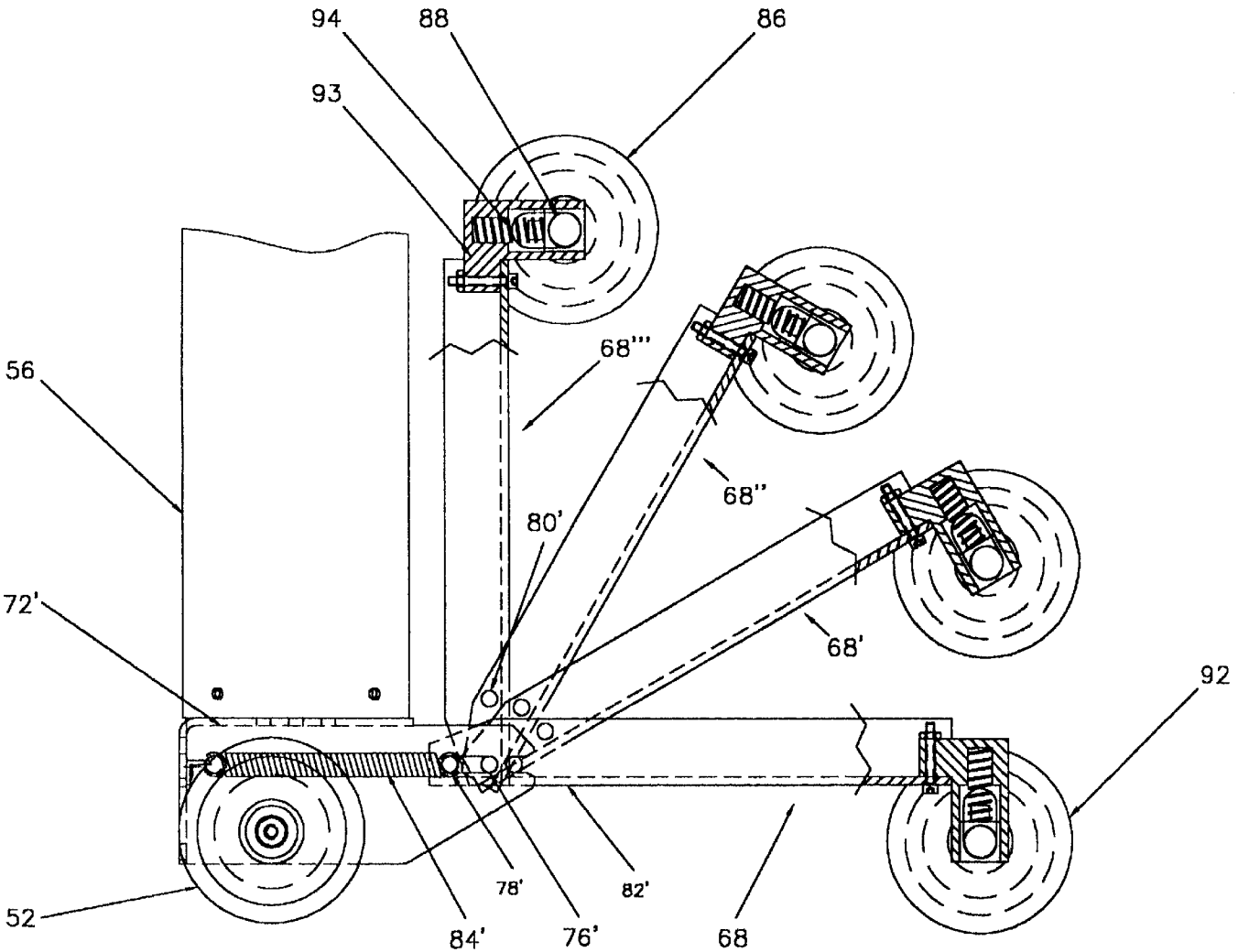
FIG. 7 is an enlarged partly sectional side elevation of the lower portion of the column, sequentially showing four angular positions of the lower stabilizing arm for suggesting the pivotal movement thereof.

FIG. 7, which refers to the lower arm 68, suggests that the latter can be forcibly pulled into its retracted limit position against the force exerted by coil spring 84', i.e. with second securing shaft 80' releasing notches 82', 82'. First pivot shaft 76' will then slidingly abut against the outer end wall of slots 78', 78' at its position shown in FIG. 7. In its extended position, arm 68 is free to pivot around pivot pin 76', from its horizontal position 68, through intermediate positions 68', 68" and into a vertical limit position 68'", in which it preferably abuts against a magnet or other suitable attachment means (not shown), registering on column 56, that holds arm 68 in this vertical position 68'". It is possible to accomplish the forcible extension of arm 68 manually, i.e. a person may counter the coil spring force by exerting an outward pressure singlehandedly. Upper arm 70 can be similarly downwardly pivoted.

Thus, it is possible to move the crimping device 50 closer to a wall or other obstructing structure by pivoting the stabilizing arms 68, 70 from their horizontal operative condition to a vertical inoperative condition, so as to position them adjacent and parallel to column 56.

FIGS. 4 to 6 show that stabilizing arm 70 further comprises a pair of stabilizing idle wheels 86*a*, 86*b*, forming a set of upper stabilizing wheels 86, which are mounted on a spindle 88 extending through slots 90, 90 formed in the wall body of sockets 91, 93. Wheels 86 should be structurally similar to wheels 54, with a V-shape rim. Spindle 88, and consequently the set of upper stabilizing wheels 86, is upwardly biased against the upper walls of slots 90, 90 by means of a pair of compressed coil springs 95*a*, 95*b* carried inside sockets 91, 93 anchored to the web of arm body 71. Thus, when upper arm 70 is pivoted against the upper U-shaped plate walls, the set of stabilizing wheels 86 engages the side walls of the ceiling plate with the springs 95*a*, 95*b* yielding under this engagement due to the slightly higher position of the stabilizing wheels set 86 relative to the upper wheels set 54. This spring-biased engagement of stabilizing wheels set 86 will help compensate any small uneveness in the upper ceiling plate, by allowing a continuous engagement of both the upper set of wheels 54 and the upper stabilizing set of wheels 86 on the ceiling plate. The same can be said about the lower set of stabilizing wheels 92 and the lower set of support wheels 52 which will continuously engage the lower sill.

Figure 10:
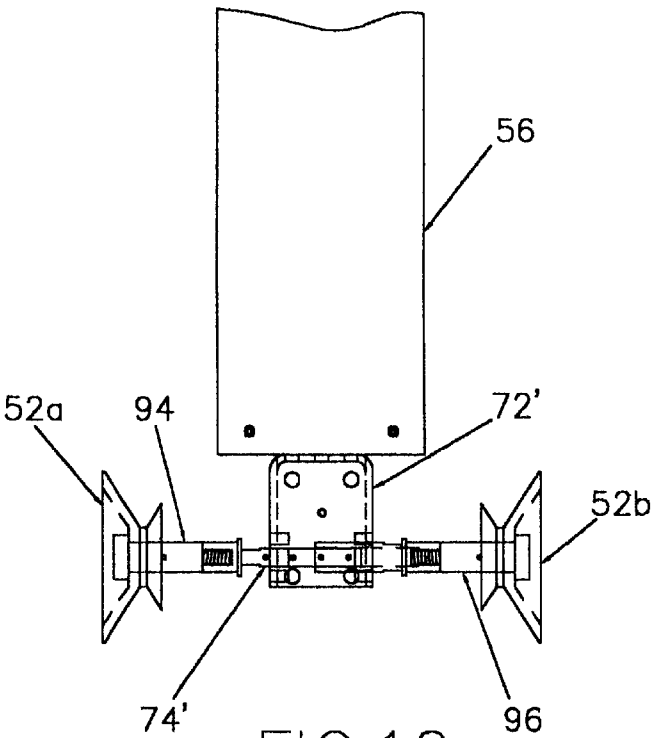
FIGS. 8 to 10 are front elevational views of the lower set of support wheels of the column together with the lower portion of the column, at an enlarged scale and partly in cross-section, showing three different wheel inter-spacings of the support wheels for engaging floor sills of different widths.
Figure 9:
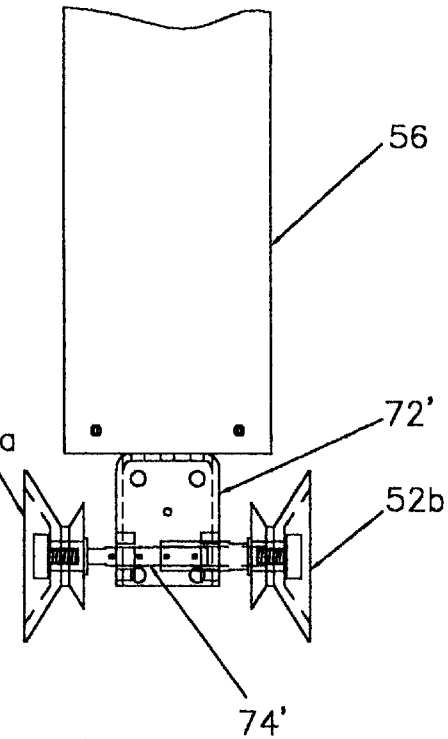
Figure 8:
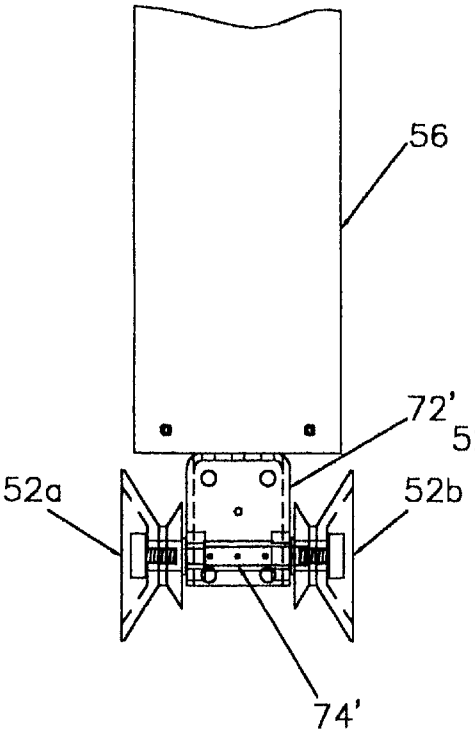

FIGS. 8 to 10 show that the lower set of V-shaped rim column wheels 52, comprising two idle wheels 52*a*, 52*b*, is mounted on a spindle 74' which is supported by the opposite side walls of U-shaped casing 72', the latter being fixedly attached to upright column 56. Spindle 74' is preferably telescopic, so as to allow different width adjustments of the lower set of support wheels 52, so that wheels 52*a*, 52*b* may engage lower sills of different widths, as suggested in FIGS. 8 and 9. FIG. 10 further shows that separate spindle extensions 94, 96 can be axially endwisely added on spindle 74', to extend same to allow even wider wheel adjustments. It is understood that the lower set of stabilizing wheels 92, the upper set of wheels 54 and the upper set of stabilizing wheels 86 are also provided with width adjustment means like the one showns in FIGS. 8 to 10.

Figure 11:
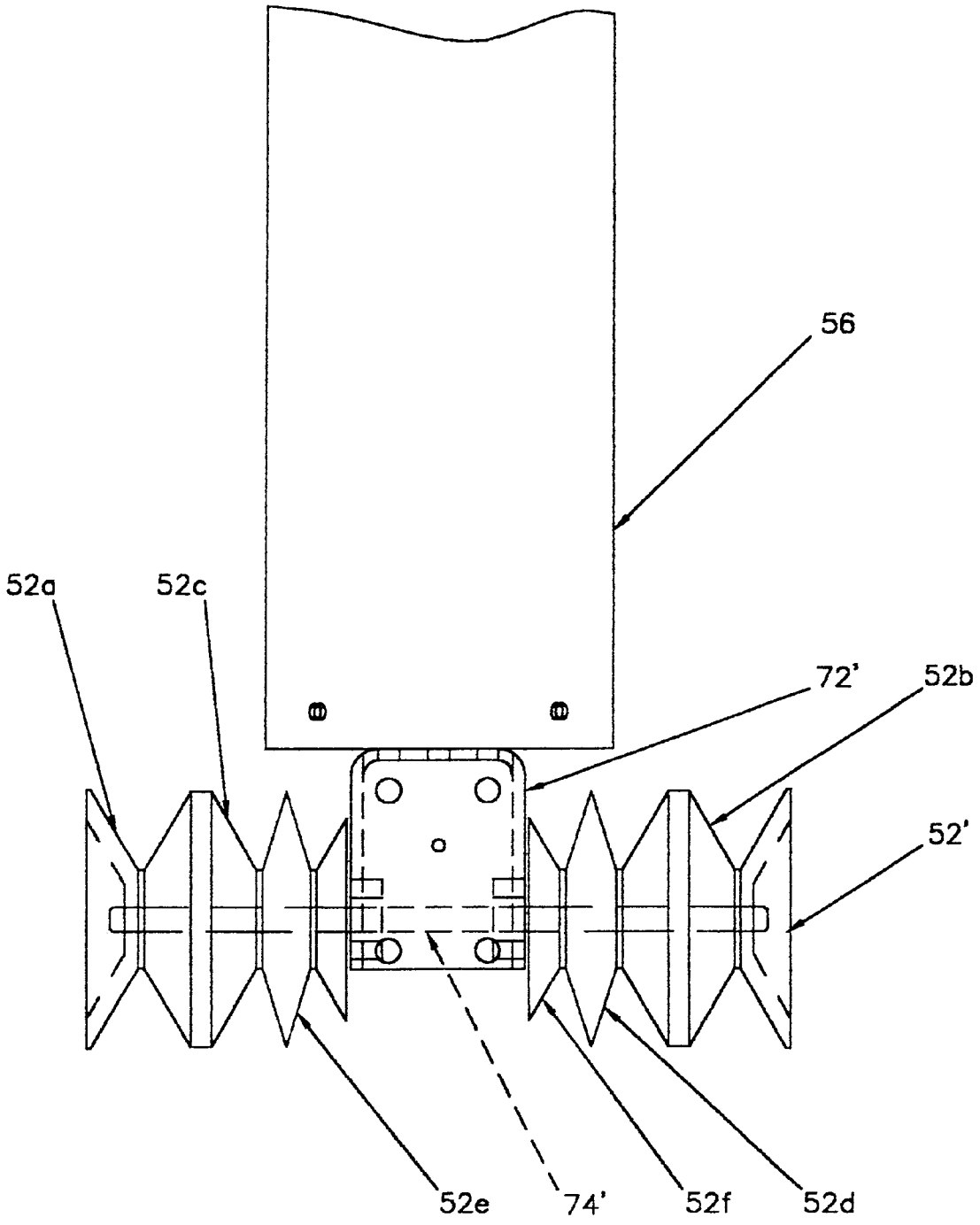
FIG. 11 is a view similar to FIGS. 8–10, but showing an alternate embodiment of a column support wheel assembly.

FIG. 11 shows an alternate means of width adjustment for the lower set of support wheels 52', wherein set 52 comprises three coaxial pairs of cross-sectionally V-shaped rims idle wheels 52*a* and 52*b*; 52*c* and 52*d*; and 52*e* and 52*f*; integrally mounted as a unitary wheel component. The latter pair of wheels is located adjacent casing 72' on opposite sides thereof, and the other pairs of wheels are axially consecutively adjacent to one another on the opposite sides of casing 72'. Thus, lower sills of different widths can be engaged, since either one of the three V-shaped rims on one side and either one of the three V-shaped rims on the other side of the set of support wheels 52, can be engaged by the pair of opposite lower sill side walls. The other wheel sets 54, 86 and 92 can of course be similarly equipped.

As shown in the drawings, all idle wheels of sets 52, 54, 86, 92 are provided with a radial cross-sectionally V-shaped rim, to allow easier manual positioning of column 56 when engagement of the wheels onto the lower sill and ceiling plate is desired.

Figure 36:
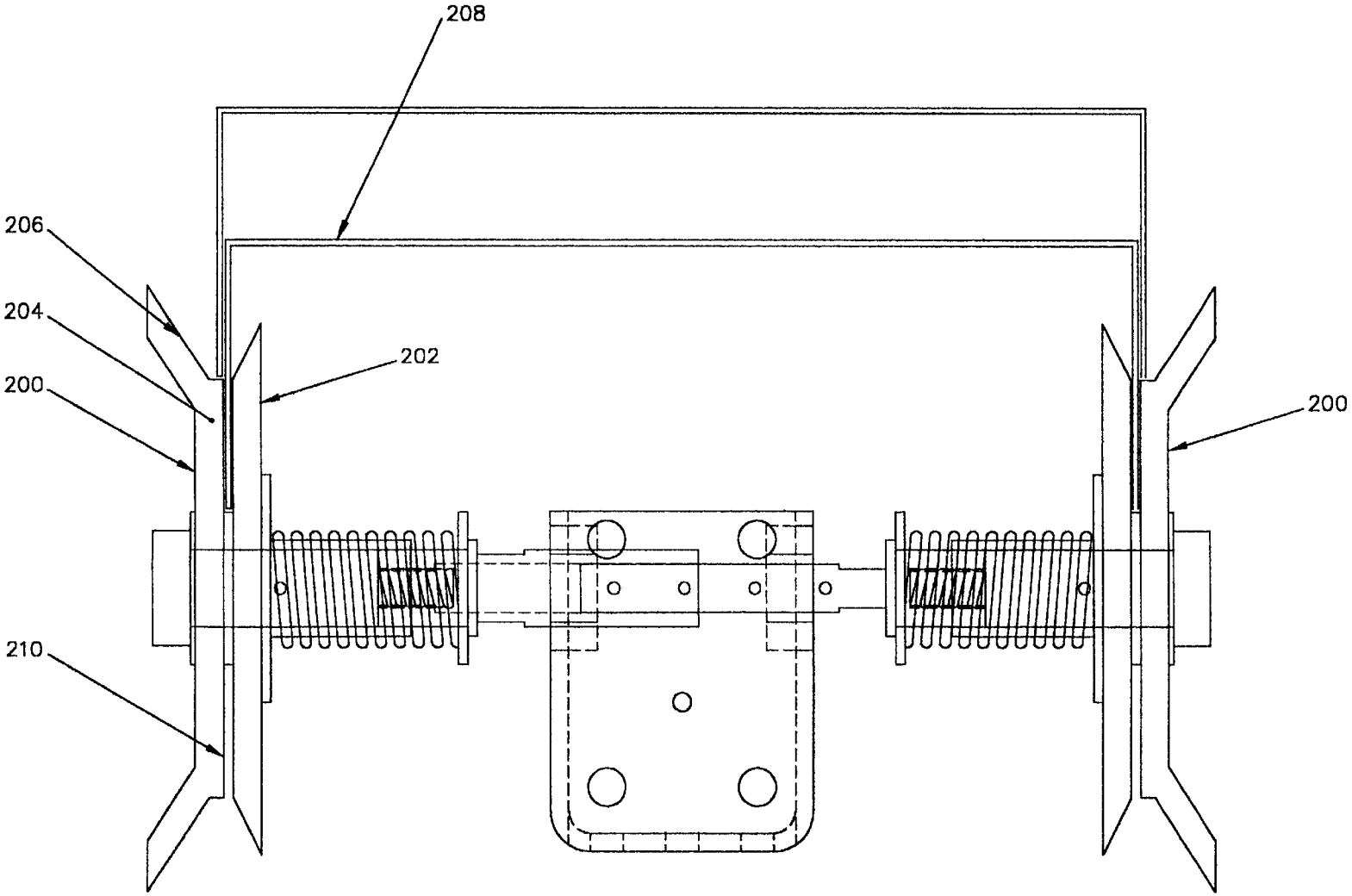
FIG. 36 is a front elevation of the upper set of wheels engaging a ceiling rail, according to an alternate embodiment of wheels.

FIG. 36 shows an alternate embodiment for the wheels 200, 200 of sets 52, 54, 86, 92. Each wheel 200 comprises slightly axially spaced inner and outer discs 202 and 204 which form the usual V-shaped groove 206 engaging the sill or ceiling rail 208. The slight spacing 210 between discs 202 and 204 is destined to be engaged by the sill or ceiling rail 208, for a stable engagement of the crimping device 50 between the sill and ceiling rails.

FIGS. 12 to 22 show the lower crimping head 98 according to the invention. Although the upper crimping head 99 is only shown in FIG. 1 of the drawings and is not detailed herein, it is understood that it is a mirror image of the lower crimping head 98.

Figure 13:
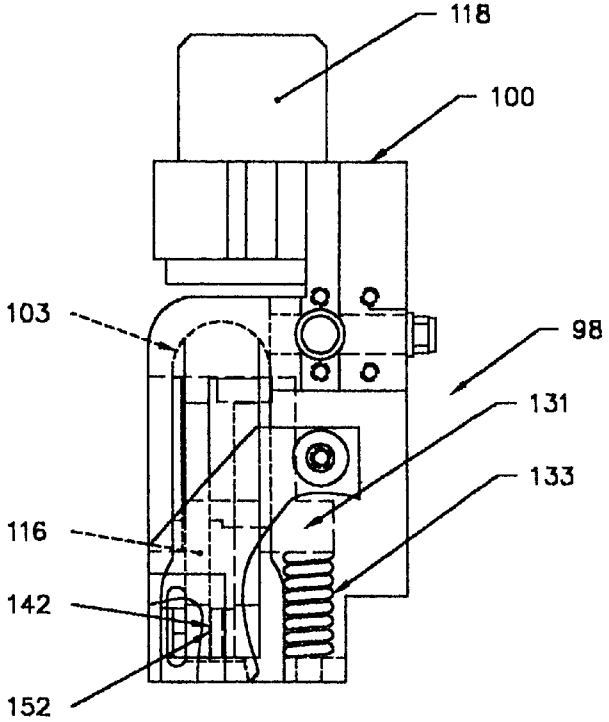
FIGS. 12 and 13 are respectively a front view and a lateral side elevation, at an enlarged scale, of the lower crimping head installed on the movable column.
Figure 12:
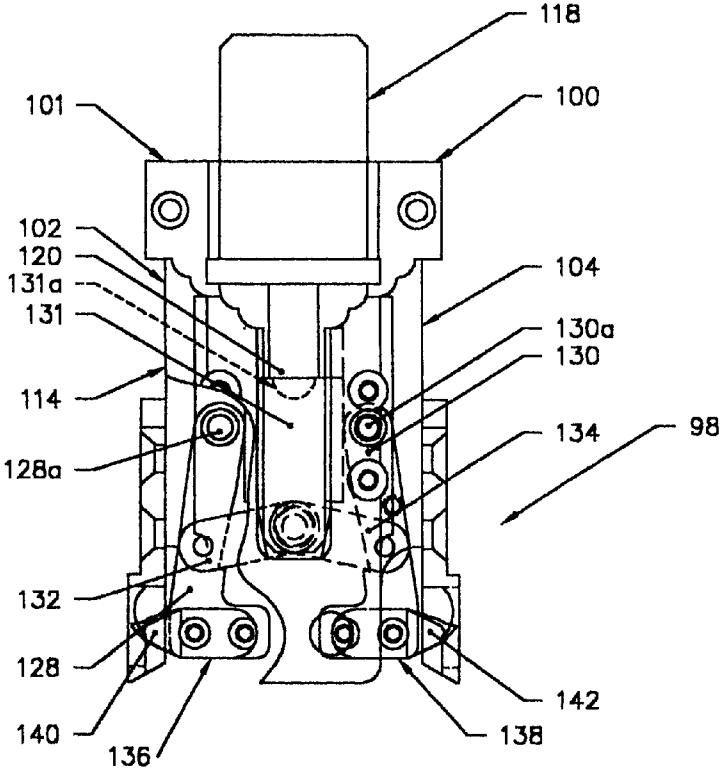

As shown in FIGS. 1, 12 and 13, crimping head 98 comprises a crimping head frame 100 which downwardly projects from and is fixedly attached to the rear portion of column 56 (i.e. on the opposite side of casing 72' and lower stabilizing arm 68). FIGS. 12 and 13 show that crimping head frame 100 comprises an upper body 101, which has downward projections 102, 104 holding in laterally outwardly spaced fashion a pair of support flat upright side panels or anvils 114, 116 that are destined to outwardly flank both the stud walls and the sill plate walls. All the previously named components of frame 100 are intergrally fixedly to one another and form a rigid structure.

The frame upper body 101 further securely holds a hydraulic cylinder 118 having a downwardly projecting piston rod 120. Cylinder 118 could alternately be controlled by pneumatic or electric means, instead of hydraulic power means, the latter being the best mode to carry out the invention. As shown in FIG. 1, lower crimping head 98 is connected via a fluid tube 121 to control means 122 installed on the lower sleeve 58 of upright column 56. Similar fluid tubes 123, 125 operationally interconnect control means 122 to upper crimping head 99. Control means 122 includes a manual lever (not shown) that can be repeatedly manually pivoted into a pumping motion, to generate and build-up fluid (e.g. oil) pressure in cylinder 118. The piston rod 120 is downwardly displaced due to the pressure-borne force of the fluid manually pumped with the lever (e.g. four up-and-down cycle motions), for gradually crimping the lower sill in a manner that will be explained hereinafter. In addition, a safety hydraulic overpressure bleed valve (not shown) could be provided as well as an air pressure relief valve inside the hydraulic network 126. The upper crimping head 99 is similarly equipped, and both hydraulic cylinders are controlled simultaneously by the single lever.

Crimping head 98 comprises a pair of pivoting fingers 128, 130 (FIGS. 12–16) that downwardly project from their pivotal attachment to frame 100 at their upper ends 128*a*, 130*a*, adjacent to piston vertical rod 120. Fingers 128, 130 are pivotally linked to the lower end of a cross-sectionally rectangular socket 131 by means of intermediate plates 132, 134. Socket 131 is located under piston rod 120 and has a semi-spherical notch 131*a* at its upper extremity for freely receiving the complementary semi-spherical lower free end of piston rod 120. Socket 131 is upwardly biased axially against piston rod 120 by means of a coil spring 133 fixed to the lower portion of frame 100. Thus, fingers 128, 130 are outwardly pivoted when piston rod 120 is extracted; and inwardly pivoted when piston rod 120 is retracted, under the upwardly driving force of the compressed coil spring 133 upon the socket 131.

To prevent accidental tilting or torque movement of socket 131 under axial load from plunger 120, a box-like housing 103 having four side walls and top and bottom mouths, is provided, so that all four side walls be parallel to socket 131 and anchored into the main frame 101, 102, 104. Reciprocating socket 131 slidingly engages side walls of the quadrangular box housing 103. Box 103 is made of a material much stronger than main frame 101, 102, . . . , e.g. tempered steel, to lower weight and cost of the main frame while providing a housing 103 having a high rigidity and a good resistance to wear.

Preferably, two side walls of the box-like housing will extend so as to support against torque movement—and be slidingly engaged by—the pivoting fingers 128, 130. Thus, fingers 128, 130 will be effectively protected from accidental and highly undesirable deformation under the load applied thereon during the crimping operation.

A knife member 136, 138 is fixedly attached to the lower free end of each pivoting finger 128, 130, respectively. Knife members 136, 138 project transversely relative to fingers 128, 130, and outwardly towards the motionless vertical side panels 114, 116, with a cutting blade 140, 142 at their outward, free extremity. Knife members 136, 138 are preferably identical, to be inverted if desired.

Figure 24:
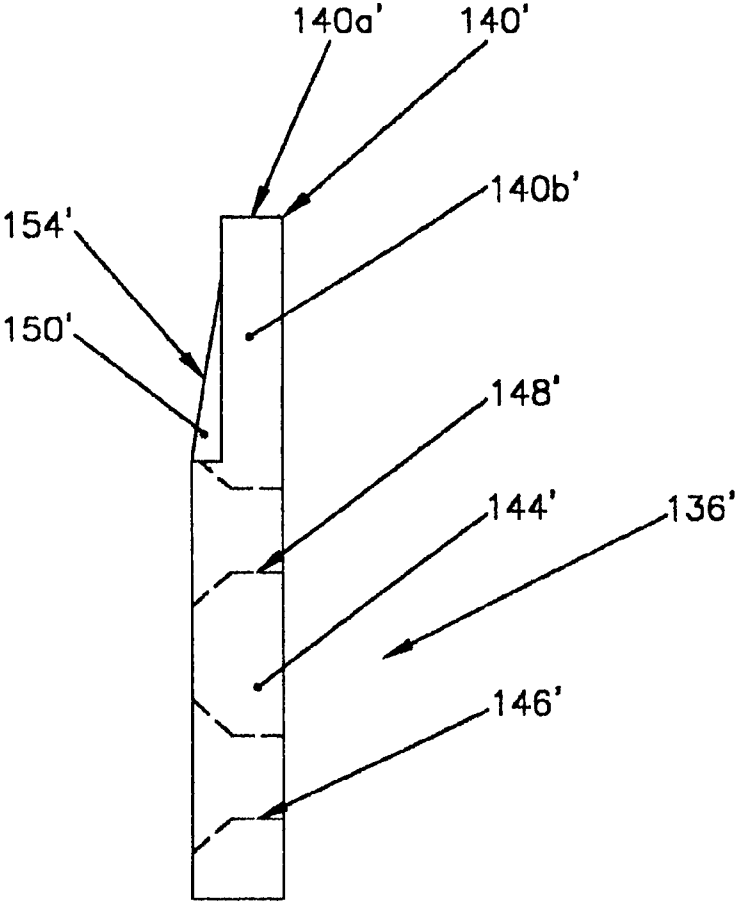
FIGS. 23 and 24 are respectively a plan view and an edge view, at an enlarged scale, of a first embodiment of the crimping knife, having two anchoring points.
Figure 23:
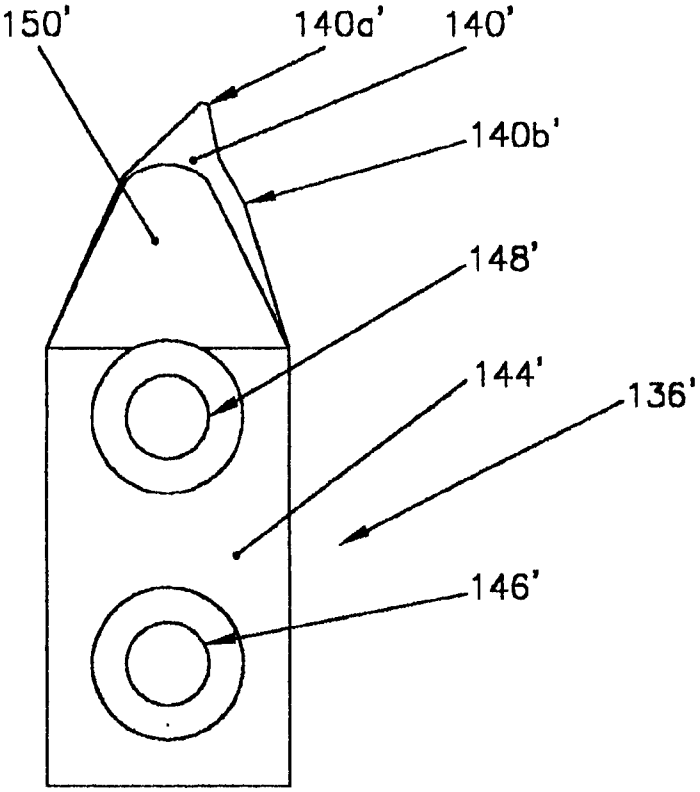

FIGS. 23 and 24 show a first embodiment of a knife member, for example a knife member 136', which is of simpler make than the one shown in FIGS. 12 to 22 and which will be described hereinafter. Numerals having apostrophes refer to similar structural parts in one and another embodiment.

Knife member 136' comprises a flat, rectangular main body 144' having a pair of countersunk bores 146', 148' to be engaged by bolts for two point anchoring of the knife member 136' to the outer ends of pivotal arms 128, 130 of crimping head 98. Knife member 136' has a triangular end 150' holding its cutting blade 140'.

In use, when the piston rod 120 is gradually extended, the knife members will be outwardly pivoted due to their attachment to the lower ends of pivoting fingers 128, 130, from an inward or resting position, to an outward or crimping position. The side walls of both the U-shaped lower sill and the vertical stud are destined to flank the knife members 136, 138, between the latter and the motionless side panels 114, 116. As seen in FIG. 13, an opening 152, 152 is provided on the side panels 114, 116, to allow the pivoting knife blades to extend therethrough. Thus, during the outward pivotal movement of the knife members 136, 138, the sill and stud side walls will be supported around the impact point of the knife blades 140, 142 by the side panels 114, 116, and the knife blades 140, 142 will pierce and crimp the side walls of both the sill and the stud, and extend through openings 152, 152.

The crimping by knife blades 140, 142 of both the side walls of the sill and the stud, which are adjacent to one another, will yieldingly and rollingly deform the metallic material of the sill and stud walls to form a pair of complementary outturned lips, with the lip of the exteriorly-positioned wall being nested within the other. These lips will help prevent horizontal movement of the stud relative to the sill and ceiling rails, although vertical movement of the stud will still be allowed under the structural vertical load of the building structure upon the stud. The horizontal immobility of the stud is acquired since the stud side wall is interiorly located relative to the sill side wall; when crimping through the walls occurs, the outturned lip of the stud side wall will trap the outturned lip of the sill side wall, since both these lips extend through the window formed by the outer upright stud side wall. One crimping operation will form four such lips, i.e. one for each knife blade, with two knife blades being located at the bottom end of the vertical stud in lower crimping head 98, and two other knife blades being located at the upper end of the stud in upper crimping head 99. With these four lips, the stud will effectively be steadfastly held between the ceiling plate and the lower sill.

Important features of the knife main body 144' are seen in FIG. 24. It can be seen that the knife blade 140' comprises a flat crimping surface 140b' originating from its pointed tip 140*a*', instead of a lengthwise cutting edge. Thus, when crimping occurs, the pointed tip 140*a*' of blade 140' will pierce the side walls of the sill and the stud, and the metallic material of the sill and the stud will be folded into an upward lip by the flat edge 140*b*' of blade 140' slidingly and deformingly engaging the sill and stud walls. Thus, the lip formed by the crimping operation will be partly located peripherally around the opening formed by the crimping, but it will mostly be formed at the upper portion of this opening.

Also, it can be seen in FIG. 24 that a single beveled side surface 154' is provided on one side of the knife triangular extremity 150'. This beveled surface 154' extends inwardly and outwardly towards tip 140*a*' by an angle of approximately 10° and prevents the knife from getting stuck in the opening formed by the blade in the sill and the stud, and consequently facilitates its retrieval.

FIGS. 25 to 28 show an alternate, preferred embodiment of a knife member, for example knife member 136, which is the knife member shown in FIGS. 12 to 22. Knife member 136 comprises a main body 144 and is bored at straight bores 146, 146*a*, 148 and 148*a* for alternate two point attachments with bolts to the lower ends of the pivoting fingers 128, 130. Either one of the pairs of bores 146, 148 or 146*a*, 148*a* can be used to bolt knife member 136 to its associated pivoting finger 128, which provides a position adjustment of the knife member 136 relative to finger 128, for reasons which will become clear hereinafter.

Figure 28:
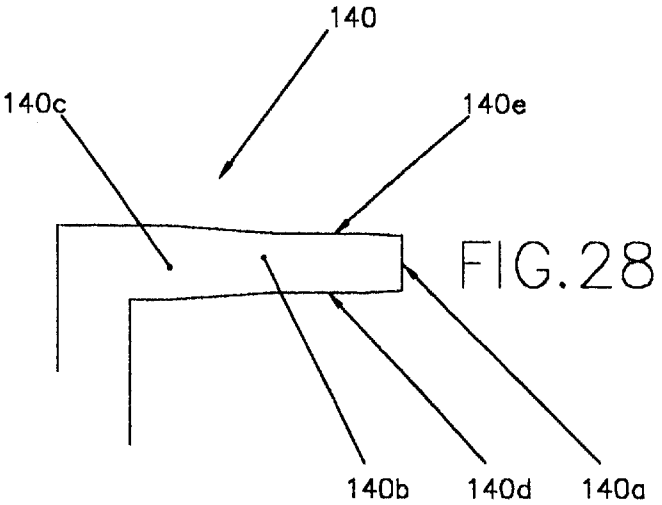
FIGS. 27 and 28 are enlarged views taken from areas 27 and 28 of FIGS. 25 and 26, respectively.
Figure 27:
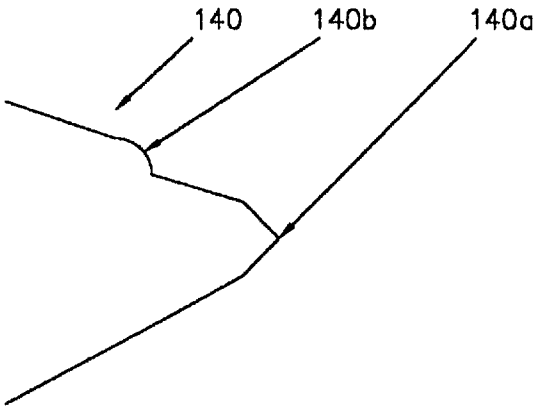

A triangular blade 140 is attached to the knife main body 144, the triangular blade 140 having an elbowed portion 140*c* at its rear end, a pointed tip 140*a* and a flat cutting surface 140*b* being provided with a notch 140*b* at its intermediate portion. Notch 140*b* promotes crimped metal rolling motion during blade penetration of the stud. FIG. 28 shows that the side surfaces 140*d*, 140*e* of blade 140 are both beveled, to promote blade retrieval from the crimped stud after it has been inserted into the metallic material of the sill and stud walls. Preferably, the total bevel angularity on each side is approximately 7°.

Figure 26:
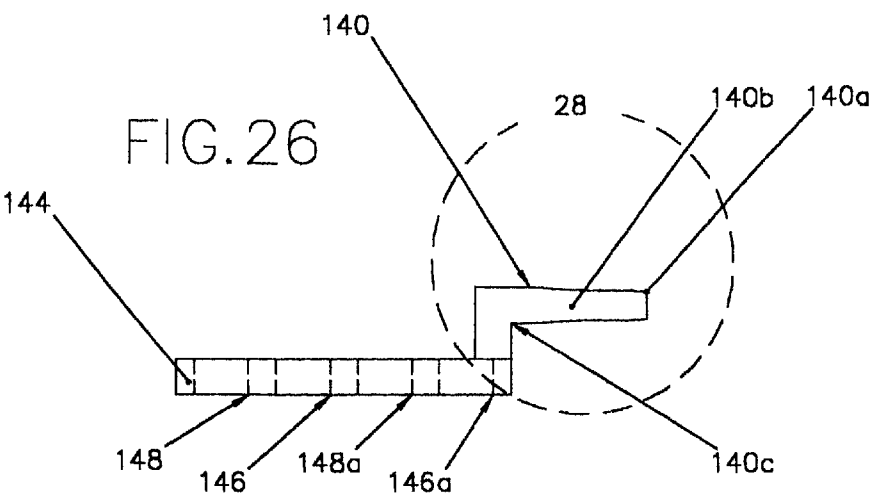
FIGS. 25 and 26 are respectively an elevational view and an end view, at an enlarged scale, of a second preferred embodiment of the crimping knife, having four anchoring points.
Figure 25:
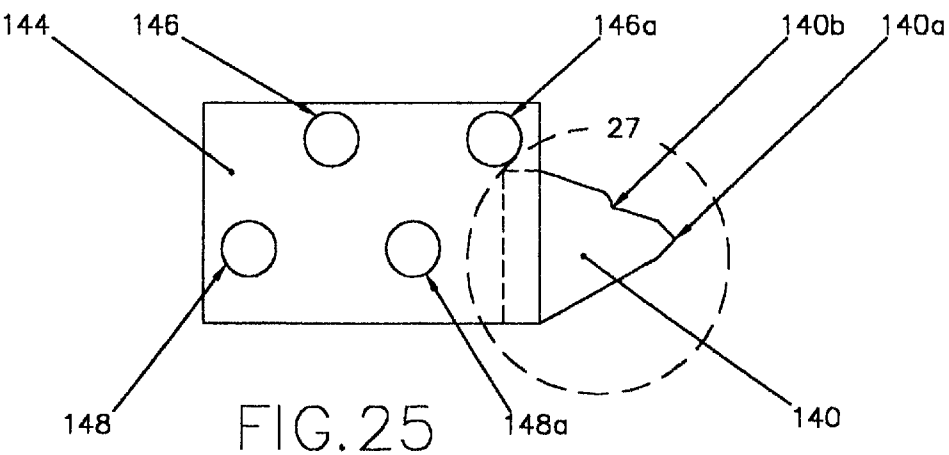

The purpose of elbow 140*c* in the body of blade 140 is FIG. 26 is to offset the two knife members 136, 138 of a pair so that the blades 140, 142 be coplanar and be allowed to come in closest proximity possible to the web of the U-shaped stud to be crimped. Indeed, as suggested in FIGS. 18 and 20, the main bodies 144, 144 of the knives 136, 138 must be offset in spaced parallel planes, since they have to pivot inwardly over one another in their retracted, resting position; this would bring the two blades 140, 142 not only to cut in non coplanar windows relative to the stud web, but also obviously one window would be further away from the stud web than another crimping window. Such an arrangement would weaken the attachment between the upright stud and the ceiling or flooring rail or plate. The elbow 140*c* allows to circumvent this problem.

Figure 16:
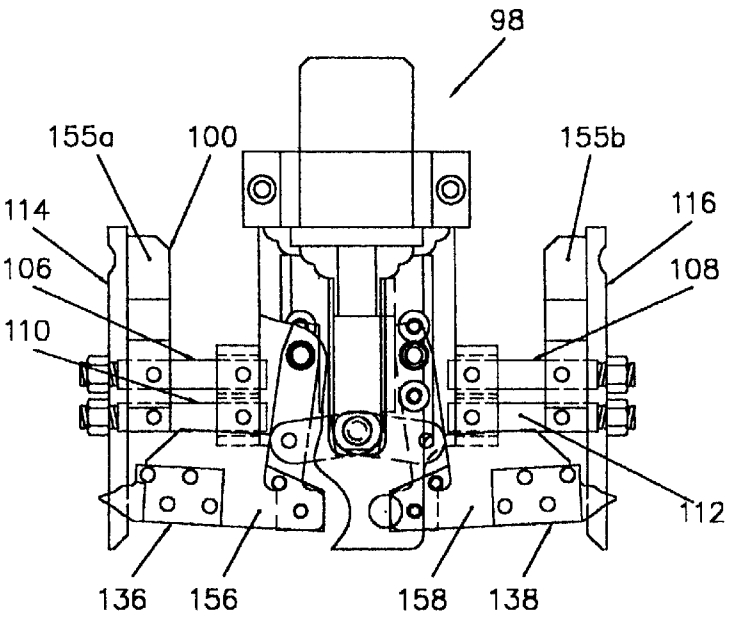
FIG. 14 to 16 are front elevational views of the lower crimping head of FIGS. 12 and 13, suggesting knife members and side panels widths adjustments, for crimping sill and stud walls of different widths.
Figure 15:
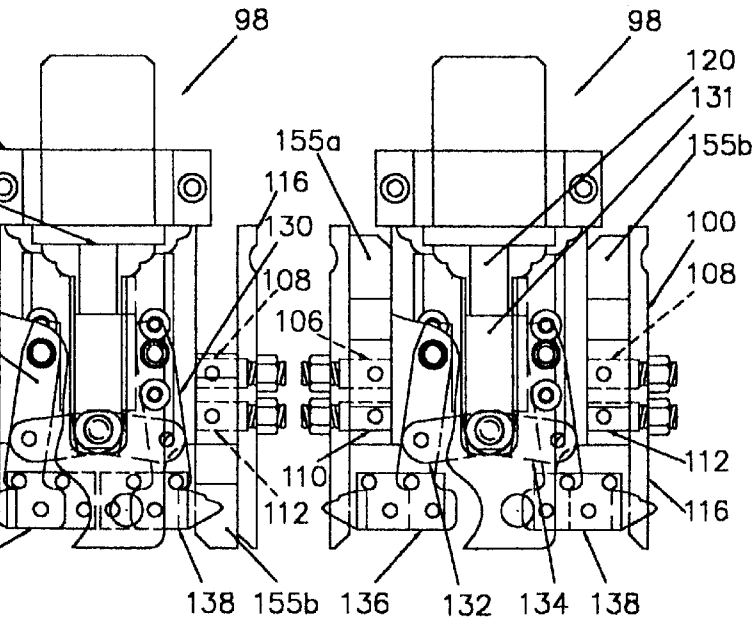
Figure 14:
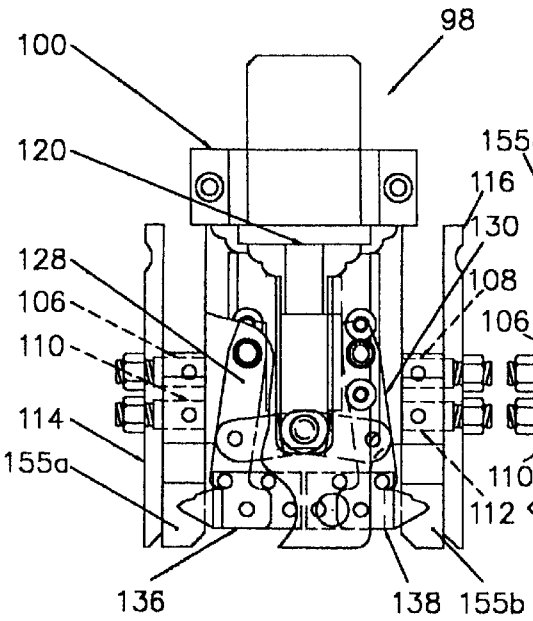

FIGS. 14 to 16 show three different arrangements of the knife members 136, 138 together with the crimping head frame 100 to fit sills of different widths. In FIG. 14, the knife members 136, 138 are adjusted to fit between the side walls of a rather narrow floor sill. The knife members 136, 138 are attached to the pivoting fingers 128, 130 at their outermost bores (146*a* and 148*a* in FIG. 25) so that the blades of the knife members protrude sidewardly as little as possible. The frame side panels 114, 116 are supported by means of threaded bars 106, 108, 110 and 112. A pair of opposite pivotable frame members 155*a*, 155*b* are downwardly fixedly installed and are destined to be in facing, spaced register with a corresponding knife member 136, 138, so as to be an anvil member therefor during the crimping operation. As seen in FIGS. 15 and 16, the innermost bores (146, 148 in FIG. 25) have been used to attach knife members 136, 138 to their respective pivoting fingers; part of the knife members main bodies thus sidewardly protrude beyond the pivoting fingers, and the knife members blades thus reach further to the side. In FIG. 15, the knife members and the crimping head frame 100 have thus been adjusted for sills of a slightly greater width, and the pivotable frame members 155*a*, 155*b* are upwardly fixedly installed after having been pivoted, to allow the knife members 136, 138 to be attached to fingers 128, 130 with their innermost bores as described hereinabove. Panels 114, 116 now serve as anvil members, being in facing, spaced register with the knife members 136, 138, since pivotable frame members 155*a*, 155*b* are now out of the way.

It can be also seen in FIG. 16 that the frame lateral panels 114, 116 could be laterally offset even more, for allowing a wider sill and stud assembly to be positioned between the knife members 136, 138 and the corresponding side panel 114, 116. This would be accomplished by telescopically extending the telescopic threaded bars 106, 108, 110, 112. FIG. 16 further shows that the knife members 136, 138 include supports 156, 158 so that the blades reach laterally further away, to crimp the sills and studs of greater widths. Pivotable frame members 155*a*, 155*b* are still pivoted upwardly, since their only purpose is to be the anvil members for the knife members 136, 138 when narrow sill rails and studs have to be crimped.

FIGS. 31 to 35 suggest the pivotable engagement of pivotable anvils 155*a*, 155*b* to frame 100. More particularly, FIGS. 32, 33 and 35 sequentially show the pivotable engagement of anvil 155*a* around a pivot bolt 159 from a first, downwardly pivoted limit position 155*a*' (as seen in FIGS. 14 and 31, 32, 33), through an intermediate position 155*a*" (FIG. 33) up to an upwardly pivoted limit position (FIGS. 15, 16, 33, 34, 35). Anvil 155*a* can be fixed in either one of its downward and upward limit positions by means of a set screw 161 engaging a complementary bore in side panel 114. It is understood that the other pivotable anvil member 155*b* is a mirror image of anvil 155*a*.

Figures 17, 18, 19, 20, 21, 22:
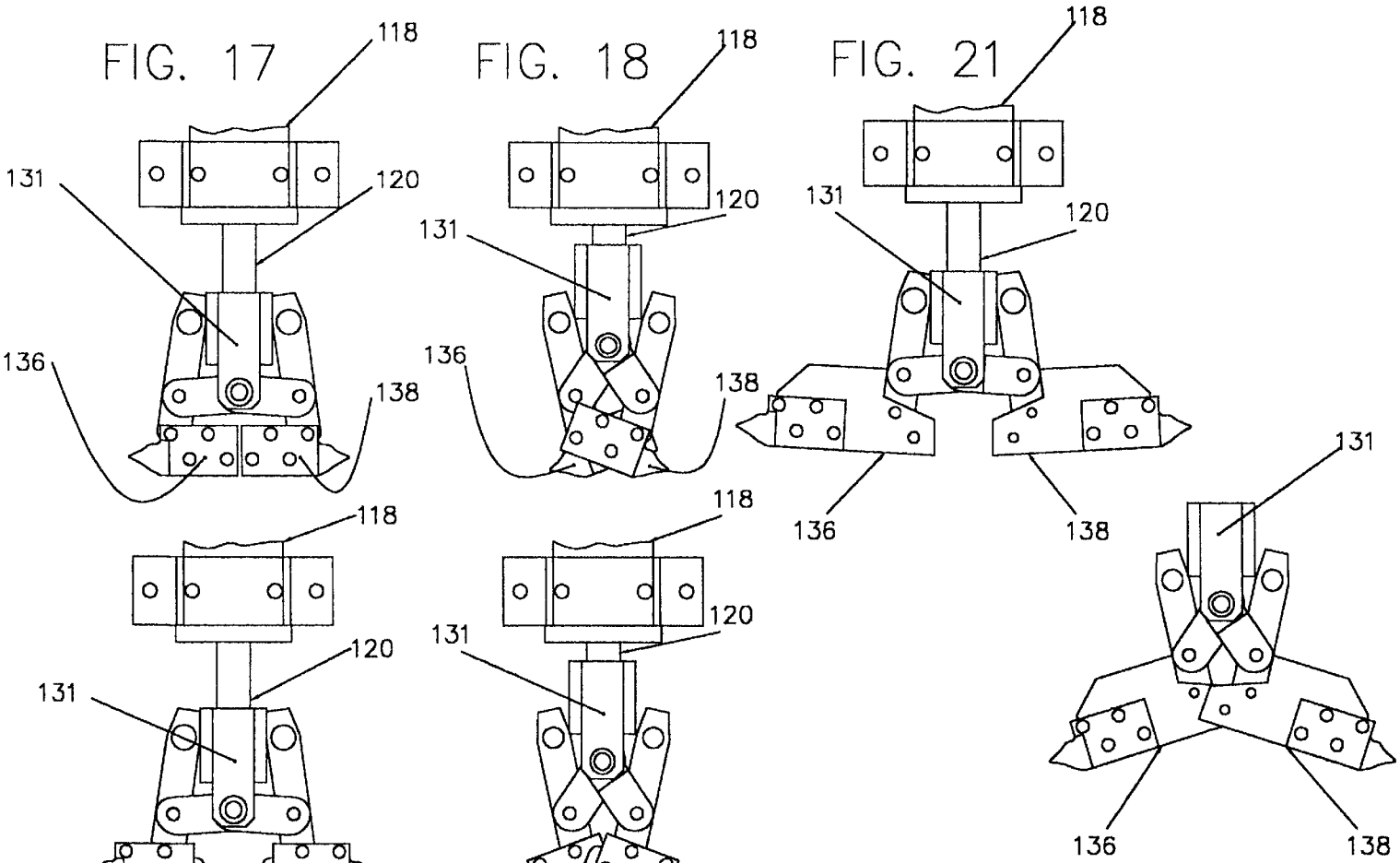
FIGS. 17 and 18 are front elevational views of the crimping knives of the lower crimping head of FIGS. 12 and 13, sequentially showing the extracted and retracted positions thereof, with the crimping knives being adjusted for a narrow structural stud and floor sill.
FIGS. 19 and 20 are similar to FIGS. 17 and 18, but with the crimping knives being adjusted for a stud and sill assembly of intermediate width.
FIGS. 21 and 22 are similar to FIG. 17 and 18, but with the crimping knives being mounted to extension members so as to be adjusted for wider studs and sills.

FIGS. 17 and 18; FIGS. 19 and 20; and FIGS. 21 and 22 respectively show the knife members 136, 138 arrangements of FIGS. 14, 15 and 16. FIGS. 17 to 22 further suggest the pivotal movement of the knife members 136, 138 under the extraction/retraction of the piston rod 120 of the hydraulic cylinder 118.

It can be seen that the retraction of the piston rod 120 (FIGS. 18, 20 and 22) releases socket 131 into an upward displacement, under the upward force exerted by the coil spring 133 (seen only in FIG. 13): the knife members 136, 138 can thus assume their inwardly pivoted limited position. It can be seen that the knife members 136, 138 pivot in planes that are offset relative to each other, so that the assembly of the two knife members 136, 138 be narrower.

When piston rod 120 is extracted (FIGS. 17, 19 and 21), the knife members pivot into their outward limit position, i.e. their crimping position. Unless driven by the sudden release of the pressure built up during the pumping operation, the knife members 136, 138 will be biased by the coil springs 133, 133 into their inwardly pivoted limit position. Thus, except during the punctual crimping operations per se, the knife members will always remain in their spring-biased inwardly pivoted limit position.

FIG. 1 shows that the crimping device 50 according to the invention also comprises guide means in the form of a pair of guide arms 160, 162 located respectively at the upper and lower ends of column 56. Lower guide arm 162 is described hereinafter, but it is understood that the upper guide arm 160 is a mirror image thereof.

Figure 29:
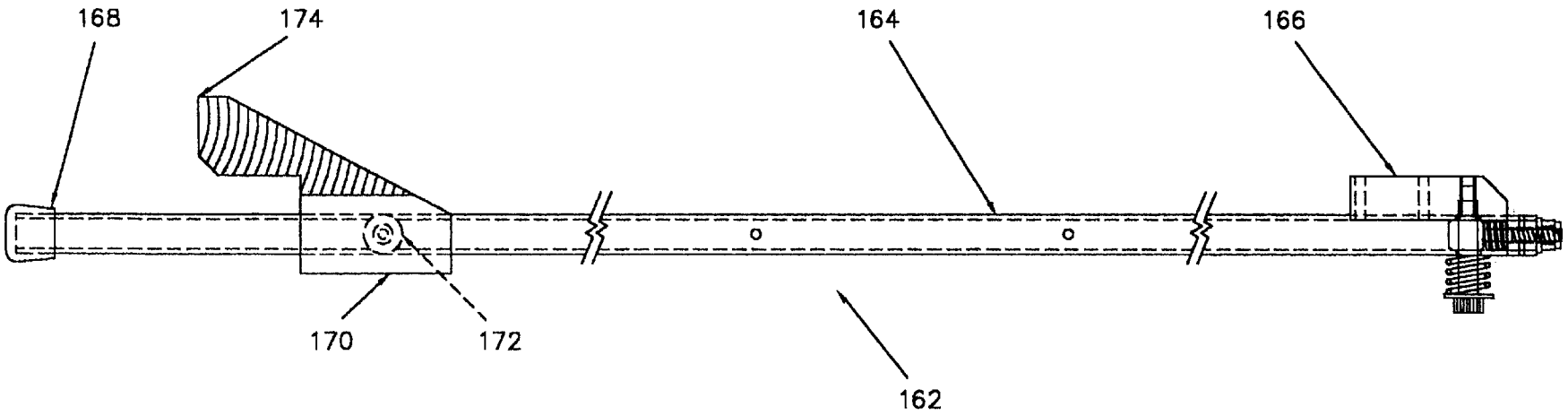
FIG. 29 is a broken top plan view, partly in cross-section and at an enlarged scale, of the transverse guide arm of the movable upright column.
Figure 30:
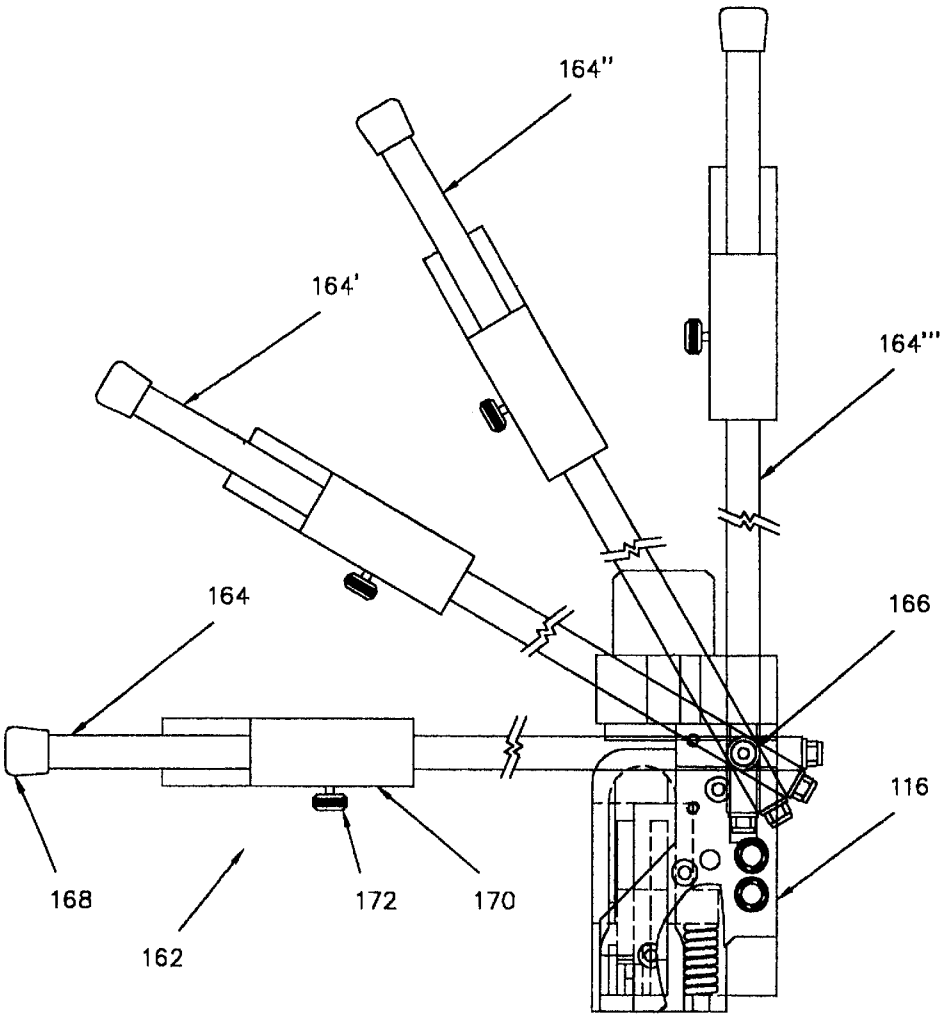
FIG. 30 is a broken top plan view of the guide arm of FIG. 29, at a smaller scale and attached to the column lower casing, further showing four different angular positions of the guide arm for suggesting the pivotal displacement thereof.
Figures 31, 32, 33, 34, 35:
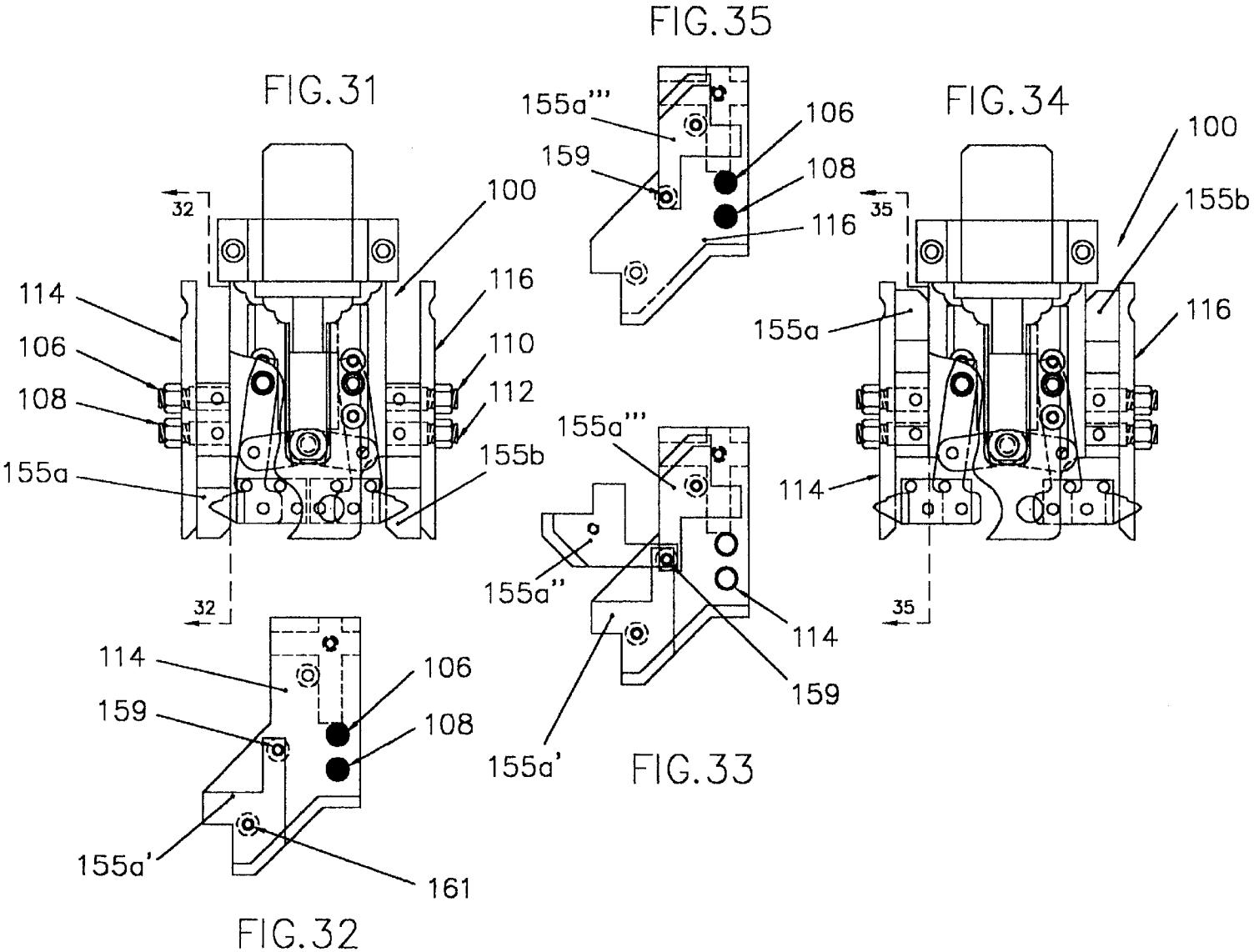
FIG. 31 is a view similar to FIG. 14.
FIG. 32 is a cross-sectional view taken along line 32—32 of FIG. 31.
FIG. 33 is a view similar to FIG. 32, but showing three sequential angular positions of the pivotable anvil member.
FIG. 34 is a view similar to FIG. 15.
FIG. 35 is a cross-sectional view taken along line 35—35 of FIG. 34.

FIGS. 29 and 30 show that lower guide arm 162 comprises an elongated bar 164 which is pivotally and springingly installed at 166 to anvil member or panel 116, so as to upwardly and downwardly freely pivot from a downward, operational limit position 164, through intermediate positions 164', 164" and to an upward limit position 164'", in which case it is adjacent and parallel to column 56. A magnet or other suitable attachment means (not shown) can be provided on column 56 to temporarily hold arm 162 in this upward position.

Arm 162 further comprises a resilient end cap 168 preventing a movable metering carriage 170 to slide off the outer free end of bar 164. Carriage 170 is indeed slidable along bar 164, on which visual monitoring marks are inscribed, so as to be able to position carriage 170 at a desired position. Carriage 170 can be temporarily immobilized by means of a set screw 172, to maintain a desired position.

Carriage 170 comprises a rigid abutment heel 174, from which the distances are to be calculated. Indeed, the purpose of guide bar 162 is to allow the worker installing the wall upright studs to position them at a regular interval. Carriage 170 is positioned at the desired position according to the monitoring marks on bar 164, and it is then immobilized by means of set screw 172. The whole column 56 is then rolled first frontwardly away from the previously installed upright stud until carriage heel 174 clears the stud, and then rolled backwardly towards the previously installed stud until carriage heel 174 abuts thereon. The next stud is then installed against the crimping heads 98, 99 for crimping to occur. The worker acquires in this way the same distance interval as the one between the two previous studs. The fact that the arm 162 is mounted to anvil 116 allows for telescopic transverse adjustment of the position of the arm relative to the lower sill rail, so that the guide arm 162 be properly positioned whatever the width of the sill and ceiling rails.

The crimping device of the invention is thus very advantageous over the known devices, especially considering that no scaffolding is required—a major health and safety advantage for workers. The crimping heads of the invention are simple to use, and do not require electric power means. The whole crimping device unit is easy to carry, since it may telescopically collapse and since no motor or other heavy power means are included. The stabilizing arms confer a stable engagement of the column onto the sill and upper plates, and the guide bars help to install the studs quickly without the use of a measuring tape. A single person is thus able to quickly and simply install a number of upright studs.

An important advantage of the present invention is the fact that the crimping occurs at both extremities of the column simultaneously, after the lever handle has been pumped a set number of times (normally four is enough) for the fluid to be injected into the hydraulic cylinders.

It is understood that any minor modifications which do not deviate from the scope of the present invention, are considered to be included therein.

For example, the idle wheels are the preferred mode to allow displacement of the column 56 along the sill and ceiling plate, but other suitable means could be used, such as sliding blocks engaging the sill and the ceiling plate.

Also, it is envisioned that the crimping head of the invention be provided with knife members which are located and would operate outwardly of the side walls of the stud and sill or stud and ceiling plate, instead of inwardly thereof. In this case, the knife members would be pivoted inwardly against the exterior wall of the stud, to crimp the walls for attaching them to each other, thus forming the attachment lips inside the channel-shaped sill, stud and ceiling plate.

It would be possible, although not desirable for optimum stability, to provide a single stabilizing arm to the crimping device, preferably at the lower end of the column, for facilitating the installation of the device between the floor sill and the ceiling plate.

It is envisioned to provide a measuring tape (not shown) fixedly attached to the column lower sleeve 58 and to the upper extremity of the anvil member 116, to allow metering of the height of the column when the intermediate and upper sleeves 60, 63 and the upper rod 62 are extended.

It is also envisioned to provide a spirit level fixedly installed on the lower sleeve 58 of the column, to allow a precise vertical positioning of the column.

Another embodiment of knife would include a an additional aligned bore to those of FIG. 23, so as to use same to adjust the position of the knife member onto its pivoting finger; however, the blade cutting windows would not be at the same short distance from the stud web.

Figure 37:
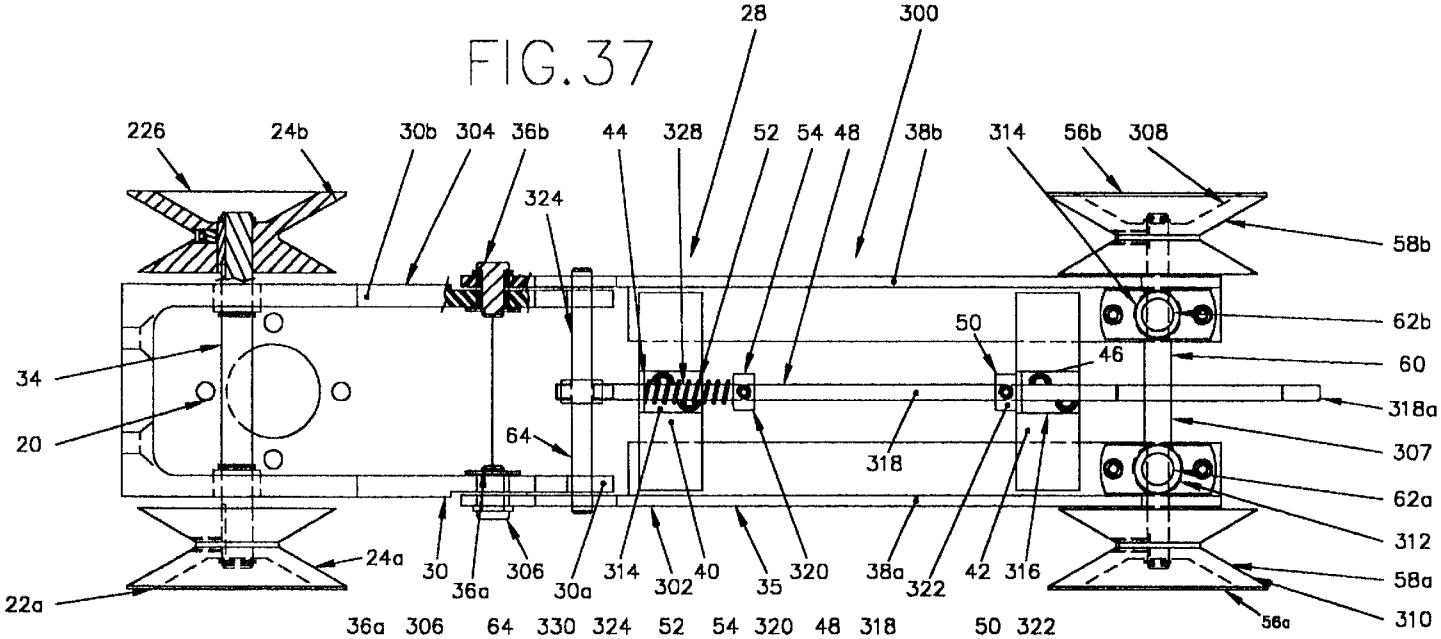
FIGS. 37 and 38 are top plan views and side elevations, at an enlarged scale, showing an alternate embodiment of a stabilizing arm mounted on the upper portion of the vertical column.
Figure 38:
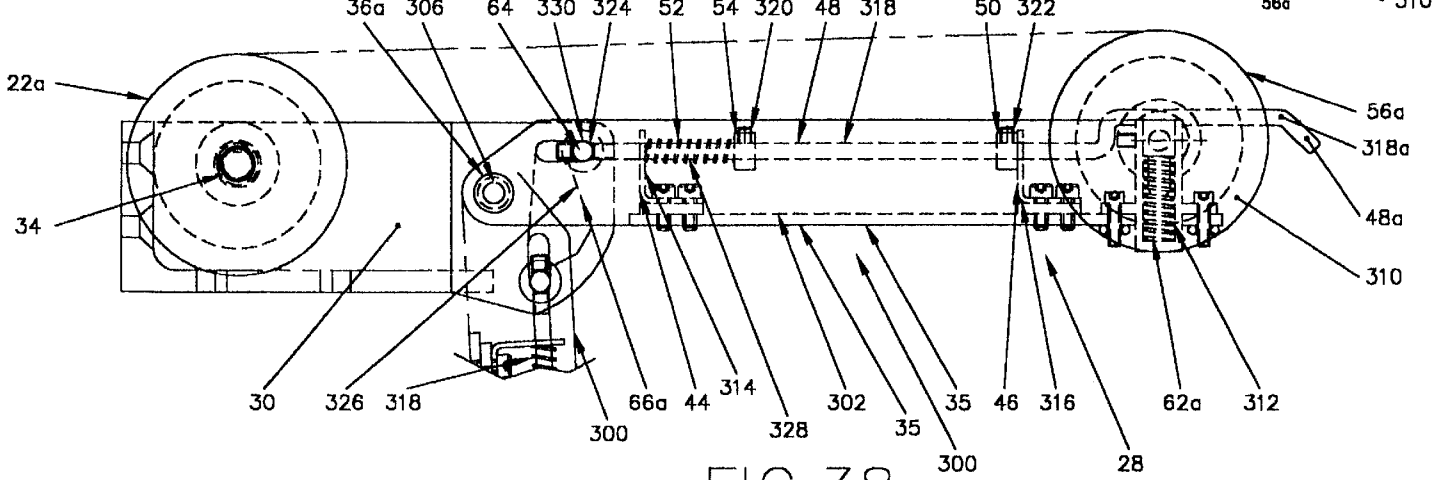

Another embodiment of stabilizing arm 300 is shown in FIGS. 37 and 38, in which the reference numerals under 300 must be ignored. Stabilizing arm 300 has an elongated main body 302 which is attached to the casing 304 of the vertical column by means of a pivot shaft 306 engaging the casing 304. The axle 307 of stabilizing wheels 308, 310 is mounted to body 302 by means of coil springs 312, 314, as the previous embodiment of stabilizing wheels.

A pair of aligned brackets 314, 316 are fixedly installed on the arm body 302, and slidably hold a rod 318 which is slidably movable in bores made in brackets 314, 316 between two limit positions which are determined by stoppers 320, 322 fixedly attached to rod 318 and spacedly installed between brackets 314, 316. Rod 318 is further pivotally attached by a shaft 324 engaging notches 330, 330 located inside a pair of openings 326, 326, and is thus held in a horizontal position, together with arm 300, shown at numerals 300 and 318 of FIG. 38, due to shaft 324 resting on notches 330, 330. It can be forcibly inwardly sled due to its outer end 318*a* abutting against a structure, e.g. a building wall, against the outward bias of a coil spring 328 compressed between bracket 314 and stopper 320. In this case, the rod pivot shaft 324 will disengage the notches 330, 330 in openings 326, 326, to dowardly pivot, with the whole arm

300, into a downward position shown as reference numerals 318' and 300' in FIG. 38.

Thus, with this second embodiment, the stabilizing arm can automatically lower itself into a downwardly pivoted position aligned with and adjacent to the upright column, when an obstructing structure is engaged by the rod 318 outer free end 318*a*. It must be manually lifted to its upper position afterwards, for it to be horizontally installed once again.

I claim:

1. A crimping unit for fixedly interconnecting a first pair of self-abutting metallic sheets and a second pair of self-abutting metallic sheets spaced from, substantially parallel to and facing the first pair of sheets, said crimping unit comprising:

a) an open rigid main frame;

b) a pair of anvil members, fixedly mounted to opposite sides of said main frame and each having an inner load-bearing surface in spaced facing register with said main frame for engagement of each pair of self-abutting metallic sheets between said main frame and a corresponding said anvil member inner load-bearing surface;

c) a pair of knives, each knife having a main body and a metal shearing surface coextensive to said main body;

d) a mounting member, for mounting said knives main body to said main frame for relative movement of said knives thereabout between an inwardly retracted inoperative position, in which each said knife shearing surface is in spaced facing register with and extends well short of a corresponding said anvil member load-bearing surface, and an outwardly extracted operative position, in which each said knife shearing surface extends beyond said corresponding anvil member load-bearing surface; and e) a selectively powered ram, for power extending said knives in generally opposite directions from their inoperative position to their operative position; wherein each said knife can impale with said knife shearing surface a corresponding pair of self-abutting metallic sheets against said corresponding anvil member load-bearing surface upon said knives being extracted into their operative position, to form windows in the metallic sheets and sheet interlocking lips transversely depending edgewisely from the windows thus interlocking the two metallic sheets forming each pair of self-abutting metallic sheets.

2. A crimping unit as in claim 1, further including:

a) a biasing member, for biasing said knives from their operative position to their inoperative position; and b) a bevel made along each said knife shearing surface, said bevel forming a small acute angle to substantially prevent the knife from getting accidentally stuck into the window formed through the metallic sheets against the bias of the biasing member, and thus to enable ready return of the knife to its inoperative position yieldingly under the bias of said biasing member.

3. A crimping unit as in claim 2, wherein said small acute angle of the bevelled knife shearing surface ranges between 4 and 100.

4. A crimping unit as in claim 1, further including a transverse notch made on an intermediate section of the knife shearing surface, said notch for promoting rolling action of the cut metal lip following sheet penetration by said knives under power from said ram, said metal lip rolling action improving sheet interlock.

5. A crimping unit as in claim 1, wherein said knives are pivotally mounted to said frame so as to be pivotable within closely spaced parallel planes during their displacement from inoperative to operative positions.

6. A crimping unit as defined in claim 1, wherein said anvil member are provided with transverse openings therein through which said knife members extend in their operative position, said anvil members thus providing support to said metallic sheets in the area around the windows formed therein by the knive shearing surfaces while allowing through-passage to said knife shearing surfaces for forming the windows.

7. A crimping unit for integrally anchoring to each other first and second elongated cross-sectionally C-shaped metallic sheets of the type having a main web and a pair of spaced parallel side walls, by anchoring each one of the pair of side walls of the first C-shaped metallic sheet to a flatly abutting corresponding side wall of the second metallic sheet, said crimping unit comprising:

a main body having a frame portion for releasable engagement between the spaced pairs of abutting side walls of the sheets;

arm members, mounted to said main body and extending outwardly therefrom;

a pair of anvil members, carried by said arm members spacedly outwardly of said frame portion for allowing each pair of spaced abutting sheet side walls to be located between a corresponding anvil member and said frame portion, each said anvil member being provided with a transverse opening therein;

a pair of knife members having a shearing tip portion and being pivotally mounted to said main body frame portion, for allowing pivotal displacement of said knife members in opposite directions between an inwardly retracted position, in which each said knife member tip portion is located adjacent said main body frame portion and in spaced facing register with a corresponding anvil member opening, and an outwardly extracted position, in which each said knife member tip portion projects outwardly through and beyond said corresponding anvil member opening; and a selectively powered ram attached to said main body and operatively linked to said knife members for allowing simultaneous pivotal displacement of said knife members upon said ram being operatively powered;

wherein, responsive to powered displacement of said ram, each said knife member is pivoted into said extracted position in which said knife member tip portion is outwardly pivoted against and through a corresponding pair of abutting sheet side walls located between said frame portion and a corresponding said anvil member, said knife member tip portion further being pivoted through and beyond said corresponding anvil opening, to pierce and create a common outturned lip in the abutting sheet side walls which anchors the metallic sheets to each other, while said corresponding anvil member supports said pair of abutting side walls in the proximal area around the impacting knife member tip portion around its said opening.

8. A crimping unit as in claim 7, wherein the length of said arm members can be adjusted for allowing selective position adjustment of said anvil members, and wherein the position of said tip portions of said knife members can also be selectively adjusted, so as to allow said crimping unit to fit into C-shaped metallic sheets of different widths.

* * * * *